US011518557B2

(12) United States Patent
Lancaster, III

(10) Patent No.: US 11,518,557 B2
(45) Date of Patent: Dec. 6, 2022

(54) PACKAGING MATERIAL GRADING AND/OR FACTORY PROFILES

(71) Applicant: Lantech.com, LLC, Louisville, KY (US)

(72) Inventor: Patrick R. Lancaster, III, Louisville, KY (US)

(73) Assignee: LANTECH.COM, LLC, Louisville, KY (US)

( * ) Notice: Subject to any disclaimer, the term of this patent is extended or adjusted under 35 U.S.C. 154(b) by 83 days.

(21) Appl. No.: 17/015,372

(22) Filed: Sep. 9, 2020

(65) Prior Publication Data

US 2021/0086927 A1 Mar. 25, 2021

Related U.S. Application Data

(60) Provisional application No. 62/902,736, filed on Sep. 19, 2019.

(51) Int. Cl.

| | |
|---|---|
| ***B65B 11/04*** | (2006.01) |
| ***B65B 57/04*** | (2006.01) |
| *B65B 11/00* | (2006.01) |
| *B65B 59/00* | (2006.01) |

(52) U.S. Cl.

CPC ..... *B65B 11/045* (2013.01); *B65B 57/04* (2013.01); *B65B 59/003* (2019.05); *B65B 2011/002* (2013.01); *B65B 2210/20* (2013.01)

(58) Field of Classification Search

USPC ..... 53/556

See application file for complete search history.

(56) References Cited

U.S. PATENT DOCUMENTS

| | | | |
|---|---|---|---|
| 2,076,617 | A | 4/1937 | Cleaves |
| 2,227,398 | A | 12/1940 | Mohl |
| 2,904,196 | A | 9/1959 | Teixeira |
| 3,029,571 | A | 4/1962 | Douthit |
| 3,707,658 | A | 12/1972 | Hilsenbeck |
| 3,776,081 | A | 12/1973 | Becker |
| 3,815,313 | A | 6/1974 | Heisler |
| 3,867,806 | A | 2/1975 | Lancaster, III |
| 3,910,005 | A | 10/1975 | Thimon et al. |
| 4,077,179 | A | 3/1978 | Lancaster et al. |
| 4,079,565 | A | 3/1978 | Lancaster, III et al. |
| 4,079,566 | A | 3/1978 | Stoecklin |
| 4,152,879 | A | 5/1979 | Shulman |

(Continued)

FOREIGN PATENT DOCUMENTS

| | | |
|---|---|---|
| CA | 2277316 A1 | 1/2001 |
| CA | 3076451 | 5/2021 |

(Continued)

OTHER PUBLICATIONS

"The Technology Behind a 'No Tear', 'No Rip' Film Carriage, and How to Explain it to your Customers," Jan. 21, 2010, downloaded from http://wulftecstretchwrapper.blogspot.com/2010_01_01archive.html on Jan. 7, 2011; 4 pages.

(Continued)

*Primary Examiner* — Chinyere J Rushing-Tucker
(74) *Attorney, Agent, or Firm* — Middleton Reutlinger

(57) ABSTRACT

Control of a load wrapping apparatus may be based at least in part on packaging material grading and/or factory profiles.

34 Claims, 11 Drawing Sheets

(56) References Cited

U.S. PATENT DOCUMENTS 4,216,640 A 8/1980 Kaufman
4,235,062 A 11/1980 Lancaster, III et al.
4,271,657 A 6/1981 Lancaster, III et al.
4,300,326 A 11/1981 Stackhouse
4,387,548 A 6/1983 Lancaster et al.
4,395,255 A 7/1983 Branecky et al.
4,418,510 A 12/1983 Lancaster, III et al.
4,429,514 A 2/1984 Lancaster et al.
4,432,185 A 2/1984 Geisinger
4,458,467 A 7/1984 Shulman et al.
4,496,417 A 1/1985 Haake et al.
4,497,159 A 2/1985 Lancaster, III
4,501,105 A 2/1985 Rogers et al.
4,503,658 A 3/1985 Mouser et al.
4,505,092 A 3/1985 Bowers et al.
4,514,955 A 5/1985 Mouser et al.
4,519,249 A 5/1985 Hunt
4,524,568 A 6/1985 Lancaster et al.
4,545,182 A 10/1985 McDowell, Jr.
4,590,746 A 5/1986 Humphrey
4,628,667 A 12/1986 Humphrey et al.
4,631,898 A 12/1986 Brambilla
4,676,048 A 6/1987 Lancaster et al.
4,682,038 A 7/1987 Focke
4,693,049 A 9/1987 Humphrey
4,712,354 A 12/1987 Lancaster et al.
4,736,567 A 4/1988 Pienta
4,754,594 A 7/1988 Lancaster
4,761,934 A 8/1988 Lancaster
4,807,427 A 2/1989 Casteel et al.
4,840,006 A 6/1989 Humphrey
4,845,920 A 7/1989 Lancaster
4,852,330 A 8/1989 Carangelo
4,862,678 A 9/1989 Humphrey
4,866,909 A 9/1989 Lancaster, III et al.
4,905,451 A 3/1990 Jaconelli et al.
4,938,008 A 7/1990 Salzsauer
4,953,336 A 9/1990 Lancaster, III et al.
4,955,176 A 9/1990 Seko et al.
4,991,381 A 2/1991 Simons
5,027,579 A 7/1991 Keip
5,040,356 A 8/1991 Thimon
5,040,359 A 8/1991 Thimon
5,054,263 A 10/1991 Maki-Rahkola et al.
5,054,987 A 10/1991 Thornton
5,077,956 A 1/1992 Thimon
5,081,824 A 1/1992 Thimon et al.
5,107,657 A 4/1992 Diehl et al.
5,123,230 A 6/1992 Upmann
5,138,817 A 8/1992 Mowry et al.
5,163,264 A 11/1992 Hannen
5,186,981 A 2/1993 Shellhamer et al.
5,195,296 A 3/1993 Matsumoto
5,195,297 A 3/1993 Lancaster et al.
5,195,301 A 3/1993 Martin-Cocher et al.
5,203,136 A 4/1993 Thimon et al.
5,203,139 A 4/1993 Salsburg et al.
5,203,671 A 4/1993 Cawley et al.
5,216,871 A 6/1993 Hannen
5,240,198 A 8/1993 Dorfel
5,301,493 A 4/1994 Chen
5,311,725 A 5/1994 Martin et al.
5,315,809 A 5/1994 Gordon et al.
5,351,461 A 10/1994 Fandard et al.
5,369,416 A 11/1994 Haverty et al.
5,414,979 A 5/1995 Moore et al.
5,426,509 A 6/1995 Peplinski
5,447,008 A 9/1995 Martin-Cocher
5,450,711 A 9/1995 Martin-Cocher
5,463,842 A 11/1995 Lancaster
5,488,814 A 2/1996 Rankin et al.
5,524,413 A 6/1996 Fukuda
5,546,730 A 8/1996 Newell et al.
5,572,850 A 11/1996 Lancaster et al.
5,572,855 A 11/1996 Reigrut et al.
5,581,979 A 12/1996 Scherer
5,595,042 A 1/1997 Cappi et al.
5,610,344 A 3/1997 Ueda et al.
5,634,321 A 6/1997 Martin-Cocher et al.
5,653,093 A 8/1997 Delledonne
5,671,593 A 9/1997 Ginestra et al.
5,765,344 A 6/1998 Mandeville et al.
5,768,862 A 6/1998 Mauro et al.
5,794,416 A 8/1998 Rahman
5,799,471 A 9/1998 Chen
5,836,140 A 11/1998 Lancaster, III
5,875,617 A 3/1999 Scherer
5,884,453 A 3/1999 Ramsey et al.
5,893,258 A 4/1999 Lancaster et al.
5,941,049 A 8/1999 Lancaster et al.
5,953,888 A 9/1999 Martin-Cocher et al.
6,082,081 A 7/2000 Mucha
6,170,228 B1 1/2001 Zeman
6,170,233 B1 1/2001 Marois et al.
6,195,968 B1 3/2001 Marois et al.
6,253,532 B1 7/2001 Orpen
6,293,074 B1 9/2001 Lancaster, III et al.
6,314,333 B1 11/2001 Rajala et al.
6,360,512 B1 3/2002 Marois et al.
6,370,839 B1 4/2002 Nakagawa
6,453,643 B1 9/2002 Buscherini et al.
6,516,591 B1 2/2003 Lancaster, III et al.
6,598,379 B2 7/2003 Zitella
6,684,612 B2 2/2004 Trottet
6,698,161 B1 3/2004 Rossi
6,748,718 B2 6/2004 Lancaster, III et al.
6,826,893 B2 12/2004 Cere'
6,848,240 B2 2/2005 Frey
6,851,252 B2 2/2005 Maki-Rahkola et al.
6,918,225 B2 7/2005 Ours et al.
6,918,229 B2 7/2005 Lancaster, III et al.
7,040,071 B2 5/2006 Heikaus
7,114,308 B2 10/2006 Cox
7,137,233 B2 11/2006 Degrasse et al.
7,178,317 B1 2/2007 Koskela
7,386,968 B2 6/2008 Sperry et al.
7,540,128 B2 6/2009 Lancaster, III et al.
7,568,327 B2 8/2009 Lancaster, III et al.
7,707,801 B2 5/2010 Lancaster, III
7,707,901 B2 5/2010 Lancaster, III et al.
7,773,226 B2 8/2010 Hofeldt et al.
7,779,607 B2 8/2010 Lancaster, III et al.
8,001,745 B2 8/2011 Carter et al.
8,037,660 B2 10/2011 Lancaster, III et al.
8,053,056 B2 11/2011 Heikaus et al.
8,276,346 B2 10/2012 Lancaster, III et al.
8,276,354 B2 10/2012 Lancaster, III et al.
8,296,101 B1 10/2012 Barlow et al.
8,424,271 B2 4/2013 Murarotto
8,539,739 B2 9/2013 Pierson et al.
8,549,819 B1 10/2013 Bison
8,707,644 B2 4/2014 Degen et al.
8,739,502 B2 6/2014 Lancaster, III
8,772,651 B2 7/2014 Martin et al.
8,939,338 B2 1/2015 Turner et al.
9,776,748 B2 10/2017 Lancaster et al.
9,896,229 B1 2/2018 Pierson et al.
10,676,292 B2 6/2020 Saylor
2001/0015057 A1 8/2001 Suolahti
2001/0017023 A1 8/2001 Armington et al.
2002/0029540 A1 3/2002 Lancaster et al.
2003/0089081 A1 5/2003 Platon
2003/0093973 A1 5/2003 Mir
2003/0110737 A1 6/2003 Lancaster et al.
2003/0145563 A1 8/2003 Cere'
2003/0158684 A1 8/2003 Livingston
2003/0200731 A1 10/2003 Maki-Rahkola et al.
2003/0200732 A1 10/2003 Maki-Rahkola et al.
2004/0031238 A1 2/2004 Cox
2004/0040477 A1 3/2004 Neumann
2004/0060264 A1 4/2004 Miller
2004/0129150 A1 7/2004 Lancaster et al.
2004/0177592 A1 9/2004 Lancaster et al.
2004/0182043 A1 9/2004 Viaud et al.

(56) References Cited

U.S. PATENT DOCUMENTS

2004/0243277 A1 12/2004 Bonnain et al.
2005/0044812 A1 3/2005 Lancaster et al.
2005/0115202 A1 6/2005 Mertz et al.
2005/0284783 A1 12/2005 May, Jr.
2006/0028969 A1 2/2006 Kondo et al.
2006/0164647 A1 7/2006 Shibata
2006/0213155 A1 9/2006 Forni et al.
2006/0248858 A1 11/2006 Lancaster
2006/0254225 A1 11/2006 Lancaster et al.
2006/0289691 A1 12/2006 Forni
2007/0169442 A1 7/2007 Asiold
2007/0204564 A1 9/2007 Lancaster et al.
2007/0204565 A1 9/2007 Lancaster et al.
2007/0209324 A1 9/2007 Lancaster et al.
2008/0066431 A1 3/2008 Cousins
2008/0216449 A1 9/2008 Zimmerli
2008/0229707 A1 9/2008 Zitella et al.
2008/0229716 A1 9/2008 Zitella et al.
2008/0295614 A1 12/2008 Lancaster, III et al.
2008/0307754 A1 12/2008 Storig et al.
2009/0178374 A1 7/2009 Lancaster, III et al.
2009/0235617 A1 9/2009 Moore et al.
2009/0277901 A1 11/2009 Port et al.
2009/0293425 A1 12/2009 Carter et al.
2009/0313942 A1 12/2009 Murarotto
2010/0037562 A1 2/2010 Forni et al.
2010/0107653 A1 5/2010 Paskevich et al.
2010/0126119 A1 5/2010 Ours
2010/0163443 A1* 7/2010 Storig ..... B65B 57/04 53/461
2010/0239403 A1 9/2010 Lancaster, III et al.
2010/0300049 A1 12/2010 Schmidt et al.
2010/0303526 A1 12/2010 Hayase
2010/0313525 A1 12/2010 Martin et al.
2010/0320305 A1 12/2010 Lia
2011/0131927 A1 6/2011 Lancaster, III et al.
2011/0146203 A1 6/2011 Lancaster, III et al.
2011/0168751 A1 7/2011 Tsurumi
2011/0179752 A1 7/2011 Lancaster, III et al.
2012/0031053 A1 2/2012 Lancaster, III et al.
2012/0042615 A1 2/2012 Roche
2012/0102886 A1 5/2012 Lancaster, III et al.
2012/0102887 A1 5/2012 Lancaster, III et al.
2012/0124944 A1 5/2012 Lancaster, III et al.
2012/0181368 A1 7/2012 Ekola
2013/0000252 A1 1/2013 Pettersson et al.
2013/0061558 A1 3/2013 Klear et al.
2013/0067865 A1 3/2013 Maruo
2013/0069284 A1 3/2013 De Bruin
2013/0076753 A1 3/2013 Lancaster, III et al.
2013/0199133 A1 8/2013 Kluge et al.
2013/0247519 A1 9/2013 Clark et al.
2013/0326999 A1 12/2013 Lemieux et al.
2014/0013707 A1 1/2014 Murarotto
2014/0053502 A1 2/2014 Pecchenini
2014/0109523 A1 4/2014 Nelson
2014/0116006 A1 5/2014 Lancaster, III et al.
2014/0116007 A1 5/2014 Lancaster, III et al.
2014/0116008 A1 5/2014 Lancaster, III et al.
2014/0123605 A1 5/2014 Cere' et al.
2014/0168422 A1 6/2014 Feng et al.
2014/0208696 A1 7/2014 Phillips et al.
2014/0223863 A1 8/2014 Lancaster et al.
2014/0223864 A1 8/2014 Lancaster, III et al.
2014/0331609 A1 11/2014 Bison
2015/0096266 A1 4/2015 Divine et al.
2015/0128530 A1 5/2015 Brunson et al.
2015/0197360 A1 7/2015 Lancaster, III
2015/0353220 A1 12/2015 Lancaster, III
2016/0096645 A1 4/2016 Lancaster et al.
2016/0096646 A1* 4/2016 Lancaster, III ..... B65B 57/16 53/461
2016/0098171 A1 4/2016 Lancaster et al.
2016/0229573 A1 8/2016 Grassi et al.
2016/0231252 A1 8/2016 Herrmann et al.
2017/0052075 A1 2/2017 Cere'
2017/0057680 A1 3/2017 Schlichting
2017/0088301 A1* 3/2017 Riemenschneider, III ..... B65B 59/003
2017/0267480 A1 9/2017 Sakamoto
2017/0327260 A1 11/2017 Lancaster
2018/0022488 A1 1/2018 Lancaster
2018/0162660 A1 6/2018 Saylor
2018/0273226 A1 8/2018 Lancaster et al.
2018/0249637 A1 9/2018 Kraus et al.
2018/0257799 A1 9/2018 Ragsdale
2018/0257802 A1 9/2018 Resch et al.
2018/0273218 A1 9/2018 Lancaster, III
2019/0002138 A1 1/2019 Laghi
2020/0039673 A1 2/2020 Mitchell et al.
2020/0377250 A1 12/2020 Lancaster, III
2021/0070485 A1 3/2021 Lancaster et al.
2021/0088637 A1 3/2021 Mitchell

FOREIGN PATENT DOCUMENTS

CN 203551161 U 4/2014
DE 3140972 A1 6/1982
DE 3119038 A1 12/1982
DE 3634924 A1 4/1988
DE 3901704 A1 8/1990
DE 4234604 A1 4/1994
DE 19509649 A1 9/1996
EP 0096635 A1 12/1983
EP 0144266 A2 6/1985
EP 0246659 A1 11/1987
EP 0466980 A1 1/1992
EP 0653352 A1 5/1995
EP 0671324 A1 9/1995
EP 0811554 A1 12/1997
EP 0842850 A2 5/1998
EP 1083126 A1 3/2001
EP 1125841 A1 8/2001
EP 1213223 A1 6/2002
EP 1489004 A1 12/2004
EP 1650573 A2 4/2006
EP 1705119 A1 9/2006
EP 1717149 A1 11/2006
EP 1736426 A2 12/2006
EP 1807308 A1 7/2007
EP 1736426 A3 10/2007
EP 3353062 A1 8/2018
EP 3656685 5/2020
EP 3733533 11/2020
EP 3941867 A1 1/2022
EP 3941868 A1 1/2022
EP 3941869 A1 1/2022
GB 1 546 523 A 5/1979
GB 2059906 A 4/1981
GB 2107668 A 5/1983
GB 2437359 A 10/2007
JP S 57166252 A 10/1982
JP S 63191707 A 8/1988
JP H 0385209 A 4/1991
JP H 06239311 A 8/1994
JP H 085448 A 1/1996
JP 09254913 A 9/1997
JP 11165705 A 6/1999
JP 2001048111 A 2/2001
JP 2001072012 A 3/2001
JP 2002211503 A 7/2002
JP 2002362879 A1 12/2002
JP 2004161344 A 6/2004
JP 3634993 B2 1/2005
JP 4350940 B2 10/2009
WO WO 9107341 A1 5/1991
WO WO 9420367 A1 9/1994
WO WO 9700202 A1 1/1997
WO WO 9822346 A1 5/1998
WO WO 2004069659 A1 8/2004
WO WO2006032065 A1 3/2006
WO WO 2006110596 A1 10/2006
WO WO 2007071593 A1 6/2007
WO WO 2007100596 A2 9/2007

(56) References Cited

FOREIGN PATENT DOCUMENTS

| | | | |
|---|---|---|---|
| WO | WO 2007100597 | A2 | 9/2007 |
| WO | WO 2008007189 | A2 | 1/2008 |
| WO | WO2008049148 | A1 | 5/2008 |
| WO | WO 2008115868 | A1 | 9/2008 |
| WO | WO 2008129432 | A1 | 10/2008 |
| WO | WO2010130011 | A1 | 11/2010 |
| WO | WO 2011057166 | A2 | 5/2011 |
| WO | WO 2012058549 | A2 | 5/2012 |
| WO | WO 2012058596 | A1 | 5/2012 |
| WO | WO2016057724 | | 4/2016 |
| WO | WO2016164776 | A1 | 10/2016 |
| WO | WO 2017053603 | A1 | 3/2017 |

OTHER PUBLICATIONS

Petronio,S. Going the Distance. Machine Design 76.10 (2004): 3, S8, S10, S12. (Year: 2004).

ASTM International (2008). Standard Test Methods for Vibration Testing of Shipping Containers. D999-08. (Year: 2008).

ASTM International (2009). Standard Test Methods for Programmable Horizaontal Impact Test for Shipping Containers and Systems. D4003-98. (Year: 2009).

Blumer, T., & Guadagnini, D. (2011). Shock transmissibility of a palletized load caused by forklift truck handling. Department of Industrial Technology, California Polytechnic State University . (Year:2011).

Cernokus, E. (2012). The Effect of Stretch Wrap Pre-stretch on Unitized Load Containment. M.S. Thesis, Department of Industrial Technology, California Polytechnic State University (Year: 2012).

Emblem, A. (2012). Packaging Technology—Fundamentals, Materials and Processed. Woodhead Publishing Ltd. (Year: 2012).

Crocker, Malcolm J. (2007). Handbook of Noise and Vibration Control. John Wiley & Sons. (Year: 2007).

European Patent Office; Communication in Application No. 18858849.5 dated May 14, 2021.

Related Applications Transmittal dated May 13, 2021.

International Search Report and Written Opinion of the International Searching Authority for Application No. PCT/US2020/049845, dated Nov. 30, 2020.

* cited by examiner

PACKAGING MATERIAL GRADING AND/OR FACTORY PROFILES

FIELD OF THE INVENTION

The invention generally relates to wrapping loads with packaging material through relative rotation of loads and a packaging material dispenser, and in particular, to a control system therefor.

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap packaging material around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

A primary metric used in the shipping industry for gauging overall wrapping effectiveness is containment force, which is generally the cumulative force exerted on the load by the packaging material wrapped around the load. Containment force depends on a number of factors, including the number of layers of packaging material, the thickness, strength and other properties of the packaging material, the amount of pre-stretch applied to the packaging material, and the wrap force applied to the load while wrapping the load. The wrap force, however, is a force that fluctuates as packaging material is dispensed to the load due primarily to the irregular geometry of the load.

In particular, wrappers have historically suffered from packaging material breaks and limitations on the amount of wrap force applied to the load (as determined in part by the amount of pre-stretch used) due to erratic speed changes required to wrap loads. Were all loads perfectly cylindrical in shape and centered precisely at the center of rotation for the relative rotation, the rate at which packaging material would need to be dispensed would be constant throughout the rotation. Typical loads, however, are generally box-shaped, and have a square or rectangular cross-section in the plane of rotation, such that even in the case of square loads, the rate at which packaging material is dispensed varies throughout the rotation. In some instances, loosely wrapped loads result due to the supply of excess packaging material during portions of the wrapping cycle where the demand rate for packaging material by the load is exceeded by the rate at which the packaging material is supplied by the packaging material dispenser. In other instances, when the demand rate for packaging material by the load is greater than the supply rate of the packaging material by the packaging material dispenser, breakage of the packaging material may occur.

When wrapping a typical rectangular load, the demand for packaging material typically decreases as the packaging material approaches contact with a corner of the load and increases after contact with the corner of the load. In horizontal rotating rings, when wrapping a tall, narrow load or a short load, the variation in the demand rate is typically even greater than in a typical rectangular load. In vertical rotating rings, high speed rotating arms, and turntable apparatuses, the variation is caused by a difference between the length and the width of the load, while in a horizontal rotating ring apparatus, the variation is caused by a difference between the height of the load (distance above the conveyor) and the width of the load. Variations in demand may make it difficult to properly wrap the load, and the problem with variations may be exacerbated when wrapping a load having one or more dimensions that may differ from one or more corresponding dimensions of a preceding load. The problem may also be exacerbated when wrapping a load having one or more dimensions that vary at one or more locations of the load itself. Furthermore, whenever a load is not centered precisely at the center of rotation of the relative rotation, the variation in the demand rate is also typically greater, as the corners and sides of even a perfectly symmetric load will be different distances away from the packaging material dispenser as they rotate past the dispenser.

The amount of force, or pull, that the packaging material exhibits on the load determines in part how tightly and securely the load is wrapped. Conventionally, this wrap force is controlled by controlling the feed or supply rate of the packaging material dispensed by the packaging material dispenser. For example, the wrap force of many conventional stretch wrapping machines is controlled by attempting to alter the supply of packaging material such that a relatively constant packaging material wrap force is maintained. With powered pre-stretching devices, changes in the force or tension of the dispensed packaging material are monitored, e.g., by using feedback mechanisms typically linked to spring loaded dancer bars, electronic load cells, or torque control devices. The changing force or tension of the packaging material caused by rotating a rectangular shaped load is transmitted back through the packaging material to some type of sensing device, which attempts to vary the speed of the motor driven dispenser to minimize the change. The passage of the corner causes the force or tension of the packaging material to increase, and the increase is typically transmitted back to an electronic load cell, spring-loaded dancer interconnected with a sensor, or to a torque control device. As the corner approaches, the force or tension of the packaging material decreases, and the reduction is transmitted back to some device that in turn reduces the packaging material supply to attempt to maintain a relatively constant wrap force or tension.

With the ever faster wrapping rates demanded by the industry, however, rotation speeds have increased significantly to a point where the concept of sensing changes in force and altering supply speed in response often loses effectiveness. The delay of response has been observed to begin to move out of phase with rotation at approximately 20 RPM. Given that a packaging dispenser is required to shift between accelerating and decelerating eight times per revolution in order to accommodate the four corners of the load, at 20 RPM the shift between acceleration and deceleration occurs at a rate of more than every once every half of a second. Given also that the rotating mass of a packaging material roll and rollers in a packaging material dispenser may be 100 pounds or more, maintaining an ideal dispense rate throughout the relative rotation can be a challenge.

Also significant is the need in many applications to minimize acceleration and deceleration times for faster cycles. Initial acceleration must pull against clamped packaging material, which typically cannot stand a high force, and especially the high force of rapid acceleration, which typically cannot be maintained by the feedback mechanisms described above. As a result of these challenges, the use of high speed wrapping has often been limited to relatively lower wrap forces and pre-stretch levels where the loss of control at high speeds does not produce undesirable packaging material breaks.

In addition, due to environmental, cost and weight concerns, an ongoing desire exists to reduce the amount of packaging material used to wrap loads, typically through the use of thinner, and thus relatively weaker packaging materials and/or through the application of fewer layers of packaging material. As such, maintaining adequate containment forces in the presence of such concerns, particularly in high speed applications, can be a challenge.

Another difficulty associated with conventional wrapping machines is based on the difficulty in selecting appropriate control parameters to ensure that an adequate containment force is applied to a load. In many wrapping machines, the width of the packaging material is significantly less than the height of the load, and a lift mechanism is used to move a roll carriage in a direction generally parallel to the axis of rotation of the wrapping machine as the load is being wrapped, which results in the packaging material being wrapped in a generally spiral manner around the load. Conventionally, an operator is able to control a number of wraps around the bottom of the load, a number of wraps around the top of the load, and a speed of the roll carriage as it traverses between the top and bottom of the load to manage the amount of overlap between successive wraps of the packaging material. In some instances, control parameters may also be provided to control an amount of overlap (e.g., in inches) between successive wraps of packaging material.

The control of the roll carriage in this manner, when coupled with the control of the wrap force applied during wrapping, may result in some loads that are wrapped with insufficient containment force throughout, or that consume excessive packaging material (which also has the side effect of increasing the amount of time required to wrap each load). In part, this may be due in some instances to an uneven distribution of packaging material, as it has been found that the overall integrity of a wrapped load is based on the integrity of the weakest portion of the wrapped load. Thus, if the packaging material is wrapped in an uneven fashion around a load such that certain portions of the load have fewer layers of overlapping packaging material and/or packaging material applied with a lower wrap force, the wrapped load may lack the desired integrity regardless of how well it is wrapped in other portions.

Ensuring even and consistent containment force throughout a load, however, has been found to be challenging, particularly for less experienced operators. Traditional control parameters such as wrap force, roll carriage speed, etc. frequently result in significant variances in number of packaging material layers and containment forces applied to loads from top to bottom. Furthermore, many operators lack sufficient knowledge of packaging material characteristics and comparative performance between different brands, thicknesses, materials, etc., so the use of different packaging materials often further complicates the ability to provide even and consistent wrapped loads.

As an example, many operators will react to excessive film breaks by simply reducing wrap force, which leads to inadvertent lowering of cumulative containment forces below desired levels. The effects of insufficient containment forces, however, may not be discovered until much later, when wrapped loads are loaded into trucks, ships, airplanes or trains and subjected to typical transit forces and conditions. Failures of wrapped loads may lead to damaged goods during transit, loading and/or unloading, increasing costs as well as inconveniencing customers, manufacturers and shippers alike.

Another approach may be to simply lower the speed of a roll carriage and increase the amount of packaging material applied in response to loads being found to lack adequate containment force; however, such an approach may consume an excessive amount of packaging material, thereby increasing costs and decreasing the throughput of a wrapping machine.

Therefore, a significant need continues to exist in the art for an improved manner of reliably and efficiently controlling the containment force applied to a wrapped load.

SUMMARY OF THE INVENTION

The invention addresses these and other problems associated with the art by providing in one aspect a method, apparatus and program product that utilize one or both of packaging material grading and factory profiles to facilitate wrapping.

Therefore, consistent with one aspect of the invention, a method of controlling a load wrapping apparatus of the type configured to wrap a load on a load support with packaging material dispensed from a packaging material dispenser through relative rotation between the packaging material dispenser and the load support may include receiving first input data associated with a packaging material thickness, receiving second input data associated with a packaging material grade, determining a wrap force parameter for use in wrapping the load using the first and second input data, and controlling a dispense rate of the packaging material dispenser during the relative rotation based on the determined wrap force parameter.

In some embodiments, the grade is selected from among a plurality of predetermined grades. Also, in some embodiments, the grade is selected from among an ultra grade, a premium grade, a standard grade and a low bid grade. In addition, some embodiments may further include maintaining a mapping of load containment forces to corresponding wrap forces and numbers of layers of packaging material and receiving third input data associated with a load containment force requirement to be used when wrapping the load with packaging material, where determining the wrap force parameter includes accessing the mapping based upon the third input data to determine a corresponding wrap force parameter and a corresponding layer parameter for the load containment force requirement, and controlling the dispense rate is further based on the determined corresponding layer parameter.

Further, in some embodiments, the layer parameter specifies a minimum number of layers of packaging material to apply throughout a contiguous region of the load. In some embodiments, the layer parameter specifies an amount of overlap between successive revolutions, a carriage or elevator speed, a number of up and/or down passes of a carriage or elevator, or a number of relative revolutions. In addition, in some embodiments, the mapping maps the corresponding wrap force and layer parameters for the load containment force requirement further based on the packaging material thickness and the packaging material grade. In some embodiments, determining the wrap force parameter is further based upon an incremental containment force, the method further including determining the incremental containment force from an incremental containment force function that varies across a range of packaging material thicknesses and a range of grades using the first and second input data.

Some embodiments may also include determining the wrap force parameter based on a factory profile. In addition, some embodiments may also include receiving third input data selecting the factory profile from a set of predefined factory profiles, each profile in the set of predefined factory profiles including one or more wrap settings and optionally one or more special wrapping features. Moreover, in some embodiments, the set of predefined factory profiles includes a regular light profile, a regular heavy profile, an irregular light profile, an irregular heavy profile, a sharp edge profile, an incomplete top layer profile, a soft top profile, a prewrapped double load profile, a short normal profile and/or a short one layer inboard profile.

Consistent with another aspect of the invention, a method of controlling a load wrapping apparatus of the type configured to wrap a load on a load support with packaging material dispensed from a packaging material dispenser through relative rotation between the packaging material dispenser and the load support may include receiving first input data selecting from among a set of predefined factory profiles, each profile in the set of predefined factory profiles including one or more wrap settings and optionally one or more special wrapping features, and controlling a dispense rate of the packaging material dispenser during the relative rotation based on the first input data and optionally performing one or more special wrapping features based upon the first input data.

In some embodiments, the set of predefined factory profiles includes a regular light profile for light loads without sharp edges and requiring no special features, and the regular light profile specifies a moderate wrap force parameter. Moreover, in some embodiments, the set of predefined factory profiles includes a regular heavy profile for heavier loads without sharp edges and requiring no special features, and the regular heavy profile specifies a high wrap force parameter. In some embodiments, the set of predefined factory profiles includes an irregular light profile for light loads and/or irregular loads with sharp edges and requiring no special features, and the irregular light profile specifies a low wrap force parameter. In addition, in some embodiments, the set of predefined factory profiles includes an irregular heavy profile for heavier loads with irregularities and/or with sharp edges and requiring no special features, and the irregular heavy profile specifies a moderate wrap force parameter.

In some embodiments, the set of predefined factory profiles includes a sharp edge profile for severely inboard loads and/or very sharp loads and requiring no special features, and the regular light profile specifies a low wrap force parameter. Moreover, in some embodiments, the set of predefined factory profiles includes an incomplete top layer profile for loads having incomplete top layers, and the incomplete top layer profile specifies a moderate wrap force parameter and a special feature that causes a rate of rotation to slow for a predetermined number of relative revolutions to allow an operator to hand rope around a top layer of the load. Also, in some embodiments, the set of predefined factory profiles includes a soft top profile for loads having top layers that are soft and/or light, and the soft top profile specifies a moderate wrap force parameter and a special feature that reduces the wrap force parameter at the top of the load for one or more relative revolutions. In some embodiments, the set of predefined factory profiles includes a prewrapped double load profile for loads having two previously-wrapped and stacked loads, and the prewrapped double load profile specifies a special feature that raises a carriage to a center of a stack of two loads, pauses until a leading end of packaging material is attached, and wraps a predetermined number of layers of packaging material around the center of the stack. In addition, in some embodiments, the set of predefined factory profiles includes a short normal profile for short loads, and the short normal profile specifies a moderate wrap force parameter and a special feature that wraps packaging material around a bottom of the load. Also, in some embodiments, the set of predefined factory profiles includes a short one layer profile for short loads requiring roping, and the short one layer profile specifies a special feature that wraps at a slow rate for a predetermined number of relative revolutions to enable an operator to hand rope around the load.

Moreover, in some embodiments, the set of predefined factory profiles includes a regular light profile, a regular heavy profile, an irregular light profile, an irregular heavy profile, a sharp edge profile, an incomplete top layer profile, a soft top profile, a prewrapped double load profile, a short normal profile and a short one layer inboard profile.

Some embodiments may also include a load wrapping apparatus including a packaging material delivery system configured to convey a web of packaging material from a packaging material roll to a body including a load to apply a controlled stretch to the packaging material prior to the packaging material being wrapped around the load and configured to perform any of the aforementioned methods. Some embodiments may also include an apparatus that includes a processor and program code configured upon execution by the processor to control a load wrapping apparatus of the type configured to wrap a load on a load support with packaging material dispensed from a packaging material dispenser through relative rotation between the packaging material dispenser and the load support using any of the aforementioned methods. Some embodiments may further include a program product that includes a non-transitory computer readable medium and program code stored on the non-transitory computer readable medium and configured to control a load wrapping apparatus of the type configured to wrap a load on a load support with packaging material dispensed from a packaging material dispenser through relative rotation between the packaging material dispenser and the load support, where the program code is configured to control the load wrapping apparatus by performing any of the aforementioned methods.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

Figure 1:
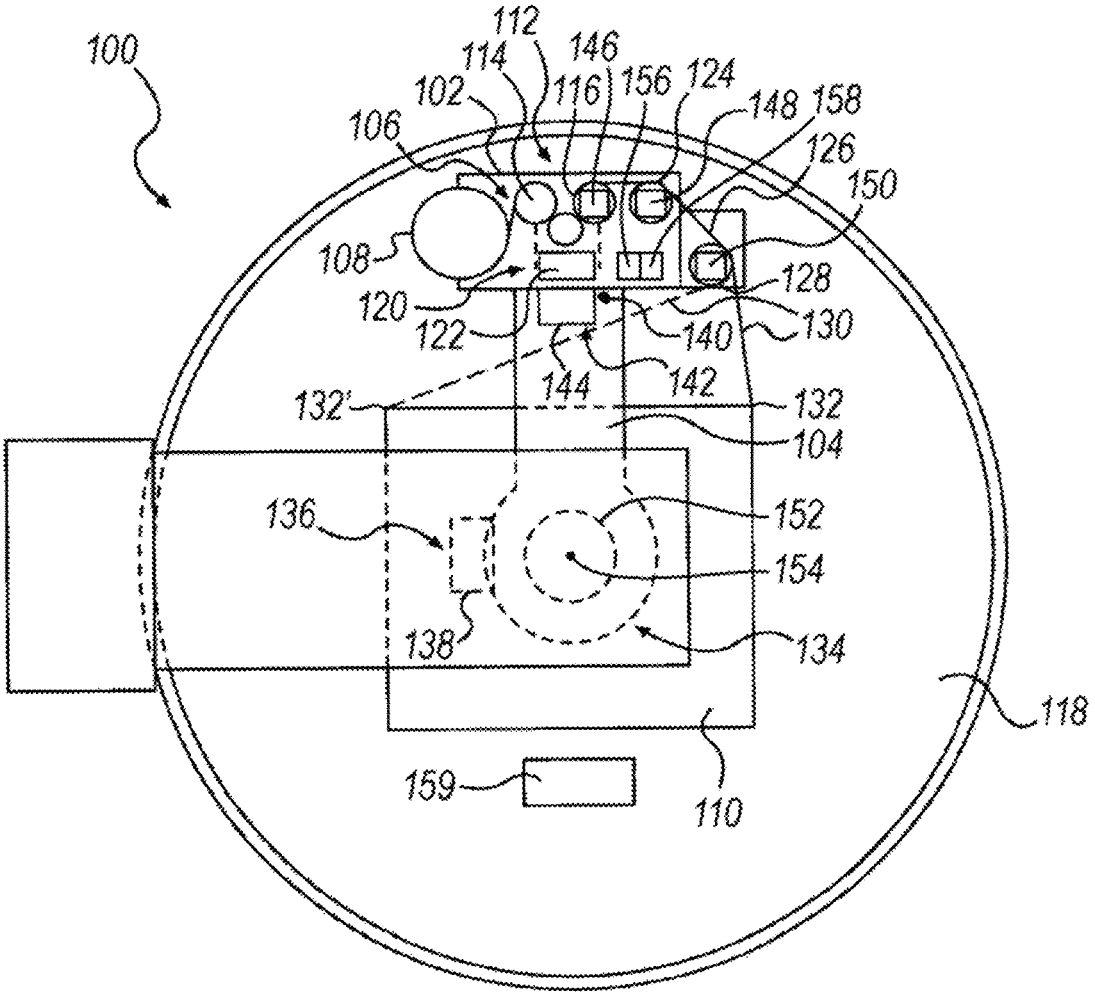
FIG. 1 shows a top view of a rotating arm-type wrapping apparatus consistent with the invention.

Embodiments consistent with the invention utilize various techniques to facilitate control of a wrapping apparatus based at least in part on the grading of a packaging material used during wrapping and/or the use of a factory profile. Prior to a discussion of the aforementioned concepts, however, a brief discussion of various types of wrapping apparatus within which the various techniques disclosed herein may be implemented is provided.

In addition, the disclosures of each of U.S. Pat. No. 4,418,510, entitled "STRETCH WRAPPING APPARATUS AND PROCESS," and filed Apr. 17, 1981; U.S. Pat. No. 4,953,336, entitled "HIGH TENSILE WRAPPING APPARATUS," and filed Aug. 17, 1989; U.S. Pat. No. 4,503,658, entitled "FEEDBACK CONTROLLED STRETCH WRAPPING APPARATUS AND PROCESS," and filed Mar. 28, 1983; U.S. Pat. No. 4,676,048, entitled "SUPPLY CONTROL ROTATING STRETCH WRAPPING APPARATUS AND PROCESS," and filed May 20, 1986; U.S. Pat. No. 4,514,955, entitled "FEEDBACK CONTROLLED STRETCH WRAPPING APPARATUS AND PROCESS," and filed Apr. 6, 1981; U.S. Pat. No. 6,748,718, entitled "METHOD AND APPARATUS FOR WRAPPING A LOAD," and filed Oct. 31, 2002; U.S. Pat. No. 7,707,801, entitled "METHOD AND APPARATUS FOR DISPENSING A PREDETERMINED FIXED AMOUNT OF PRE-STRETCHED FILM RELATIVE TO LOAD GIRTH," filed Apr. 6, 2006; U.S. Pat. No. 8,037,660, entitled "METHOD AND APPARATUS FOR SECURING A LOAD TO A PALLET WITH A ROPED FILM WEB," and filed Feb. 23, 2007; U.S. Patent Application Publication No. 2007/0204565, entitled "METHOD AND APPARATUS FOR METERED PRE-STRETCH FILM DELIVERY," and filed Sep. 6, 2007; U.S. Pat. No. 7,779,607, entitled "WRAPPING APPARATUS INCLUDING METERED PRE-STRETCH FILM DELIVERY ASSEMBLY AND METHOD OF USING," and filed Feb. 23, 2007; U.S. Patent Application Publication No. 2009/0178374, entitled "ELECTRONIC CONTROL OF METERED FILM DISPENSING IN A WRAPPING APPARATUS," and filed Jan. 7, 2009; U.S. Patent Application Publication No. 2011/0131927, entitled "DEMAND BASED WRAPPING," and filed Nov. 6, 2010; U. S. Patent Application Publication No. 2012/0102886, entitled "METHODS AND APPARATUS FOR EVALUATING PACKAGING MATERIALS AND DETERMINING WRAP SETTINGS FOR WRAPPING MACHINES," and filed Oct. 28, 2011; U. S. Patent Application Publication No. 2012/0102887, entitled "MACHINE GENERATED WRAP DATA," and filed Oct. 28, 2011; U.S. provisional patent application Ser. 61/718,429, entitled "ROTATION ANGLE-BASED WRAPPING," and filed Oct. 25, 2012; U.S. provisional patent application Ser. No. 61/718,433, entitled "EFFECTIVE CIRCUMFERENCE-BASED WRAPPING," and filed Oct. 25, 2012; U.S. patent application Ser. No. 14/052,929, entitled "ROTATION ANGLE-BASED WRAPPING," and filed Oct. 25, 2013; U.S. patent application Ser. No. 14/052,930, entitled "EFFECTIVE CIRCUMFERENCE-BASED WRAPPING," and filed Oct. 25, 2013; U.S. patent application Ser. No. 14/052,931, entitled "CORNER GEOMETRY-BASED WRAPPING," and filed Oct. 25, 2013; U.S. provisional patent application Ser. No. 61/764,107, entitled "CONTAINMENT FORCE-BASED WRAPPING," and filed Feb. 13, 2013; U.S. Patent Application Publication No. 2014/0223,863, entitled "PACKAGING MATERIAL PROFILING FOR CONTAINMENT FORCE-BASED WRAPPING," and filed Feb. 13, 2014; U.S. Patent Application Publication No. 2014/0223,864, entitled "CONTAINMENT FORCE-BASED WRAPPING," and filed Feb. 13, 2014; U.S. Patent Application Publication No. 2016/0096646, entitled "LOAD STABILITY-BASED WRAPPING," and filed Oct. 7, 2015; and U.S. provisional patent application Ser. No. 62/821,146, entitled "PACKAGING MATERIAL EVALUATION AND TEST APPARATUS THEREFOR," and filed Mar. 20, 2019, are incorporated herein by reference in their entirety.

Wrapping Apparatus Configurations

FIG. 1, for example, illustrates a rotating arm-type wrapping apparatus 100, which includes a roll carriage 102 mounted on a rotating arm 104. Roll carriage 102 may include a packaging material dispenser 106. Packaging material dispenser 106 may be configured to dispense packaging material 108 as rotating arm 104 rotates relative to a load 110 to be wrapped. In an example embodiment, packaging material dispenser 106 may be configured to dispense stretch wrap packaging material. As used herein, stretch wrap packaging material is defined as material having a high yield coefficient to allow the material a large amount of stretch during wrapping. However, it is possible that the apparatuses and methods disclosed herein may be practiced with packaging material that will not be pre-stretched prior to application to the load. Examples of such packaging material include netting, strapping, banding, tape, etc. The invention is therefore not limited to use with stretch wrap packaging material. In addition, as used herein, the terms "packaging material," "web," "film," "film web," and "packaging material web" may be used interchangeably.

Packaging material dispenser 106 may include a pre-stretch assembly 112 configured to pre-stretch packaging material before it is applied to load 110 if pre-stretching is desired, or to dispense packaging material to load 110 without pre-stretching. Pre-stretch assembly 112 may include at least one packaging material dispensing roller, including, for example, an upstream dispensing roller 114 and a downstream dispensing roller 116. It is contemplated that pre-stretch assembly 112 may include various configurations and numbers of pre-stretch rollers, drive or driven roller and idle rollers without departing from the spirit and scope of the invention.

The terms "upstream" and "downstream," as used in this application, are intended to define positions and movement relative to the direction of flow of packaging material 108 as it moves from packaging material dispenser 106 to load 110. Movement of an object toward packaging material dispenser 106, away from load 110, and thus, against the direction of flow of packaging material 108, may be defined as "upstream." Similarly, movement of an object away from packaging material dispenser 106, toward load 110, and thus, with the flow of packaging material 108, may be defined as "downstream." Also, positions relative to load 110 (or a load support surface 118) and packaging material dispenser 106 may be described relative to the direction of packaging material flow. For example, when two pre-stretch rollers are present, the pre-stretch roller closer to packaging material dispenser 106 may be characterized as the "upstream" roller and the pre-stretch roller closer to load 110 (or load support 118) and further from packaging material dispenser 106 may be characterized as the "downstream" roller.

A packaging material drive system 120, including, for example, an electric motor 122, may be used to drive dispensing rollers 114 and 116. For example, electric motor 122 may rotate downstream dispensing roller 116. Downstream dispensing roller 116 may be operatively coupled to upstream dispensing roller 114 by a chain and sprocket assembly, such that upstream dispensing roller 114 may be driven in rotation by downstream dispensing roller 116. Other connections may be used to drive upstream roller 114 or, alternatively, a separate drive (not shown) may be provided to drive upstream roller 114.

Downstream of downstream dispensing roller 116 may be provided one or more idle rollers 124, 126 that redirect the web of packaging material, with the most downstream idle roller 126 effectively providing an exit point 128 from packaging material dispenser 102, such that a portion 130 of packaging material 108 extends between exit point 128 and a contact point 132 where the packaging material engages load 110 (or alternatively contact point 132' if load 110 is rotated in a counter-clockwise direction).

Wrapping apparatus 100 also includes a relative rotation assembly 134 configured to rotate rotating arm 104, and thus, packaging material dispenser 106 mounted thereon, relative to load 110 as load 110 is supported on load support surface 118. Relative rotation assembly 134 may include a rotational drive system 136, including, for example, an electric motor 138. It is contemplated that rotational drive system 136 and packaging material drive system 120 may run independently of one another. Thus, rotation of dispensing rollers 114 and 116 may be independent of the relative rotation of packaging material dispenser 106 relative to load 110. This independence allows a length of packaging material 108 to be dispensed per a portion of relative revolution that is neither predetermined nor constant. Rather, the length may be adjusted periodically or continuously based on changing conditions.

Wrapping apparatus 100 may further include a lift assembly 140. Lift assembly 140 may be powered by a lift drive system 142, including, for example, an electric motor 144, that may be configured to move roll carriage 102 vertically relative to load 110. Lift drive system 142 may drive roll carriage 102, and thus packaging material dispenser 106, upwards and downwards vertically on rotating arm 104 while roll carriage 102 and packaging material dispenser 106 are rotated about load 110 by rotational drive system 136, to wrap packaging material spirally about load 110.

One or more of downstream dispensing roller 116, idle roller 124 and idle roller 126 may include a corresponding sensor 146, 148, 150 to monitor rotation of the respective roller. In particular, rollers 116, 124 and/or 126, and/or packaging material 108 dispensed thereby, may be used to monitor a dispense rate of packaging material dispenser 106, e.g., by monitoring the rotational speed of rollers 116, 124 and/or 126, the number of rotations undergone by such rollers, the amount and/or speed of packaging material dispensed by such rollers, and/or one or more performance parameters indicative of the operating state of packaging material drive system 120, including, for example, a speed of packaging material drive system 120. The monitored characteristics may also provide an indication of the amount of packaging material 108 being dispensed and wrapped onto load 110. In addition, in some embodiments a sensor, e.g., sensor 148 or 150, may be used to detect a break in the packaging material.

Wrapping apparatus also includes an angle sensor 152 for determining an angular relationship between load 110 and packaging material dispenser 106 about a center of rotation 154 (through which projects an axis of rotation that is perpendicular to the view illustrated in FIG. 1). Angle sensor 152 may be implemented, for example, as a rotary encoder, or alternatively, using any number of alternate sensors or sensor arrays capable of providing an indication of the angular relationship and distinguishing from among multiple angles throughout the relative rotation, e.g., an array of proximity switches, optical encoders, magnetic encoders, electrical sensors, mechanical sensors, photodetectors, motion sensors, etc. The angular relationship may be represented in some embodiments in terms of degrees or fractions of degrees, while in other embodiments a lower resolution may be adequate. It will also be appreciated that an angle sensor consistent with the invention may also be disposed in other locations on wrapping apparatus 100, e.g., about the periphery or mounted on arm 104 or roll carriage 102. In addition, in some embodiments angular relationship may be represented and/or measured in units of time, based upon a known rotational speed of the load relative to the packaging material dispenser, from which a time to complete a full revolution may be derived such that segments of the revolution time would correspond to particular angular relationships.

Additional sensors, such as a load distance sensor 156 and/or a film angle sensor 158, may also be provided on wrapping apparatus 100. Load distance sensor 156 may be used to measure a distance from a reference point to a surface of load 110 as the load rotates relative to packaging material dispenser 106 and thereby determine a cross-sectional dimension of the load at a predetermined angular position relative to the packaging material dispenser. In one embodiment, load distance sensor 156 measures distance along a radial from center of rotation 154, and based on the known, fixed distance between the sensor and the center of rotation, the dimension of the load may be determined by subtracting the sensed distance from this fixed distance. Sensor 156 may be implemented using various types of distance sensors, e.g., a photoeye, proximity detector, laser distance measurer, ultrasonic distance measurer, electronic rangefinder, and/or any other suitable distance measuring device. Exemplary distance measuring devices may include, for example, an IFM Effector 01D100 and a Sick UM30-213118 (6036923).

Film angle sensor 158 may be used to determine a film angle for portion 130 of packaging material 108, which may be relative, for example, to a radial (not shown in FIG. 1) extending from center of rotation 154 to exit point 128 (although other reference lines may be used in the alternative).

In one embodiment, film angle sensor 158 may be implemented using a distance sensor, e.g., a photoeye, proximity detector, laser distance measurer, ultrasonic distance measurer, electronic rangefinder, and/or any other suitable distance measuring device. In one embodiment, an IFM Effector 01D100 and a Sick UM30-213118 (6036923) may be used for film angle sensor 158. In other embodiments, film angle sensor 158 may be implemented mechanically, e.g., using a cantilevered or rockered follower arm having a free end that rides along the surface of portion 130 of packaging material 108 such that movement of the follower arm tracks movement of the packaging material. In still other embodiments, a film angle sensor may be implemented by a force sensor that senses force changes resulting from movement of portion 130 through a range of film angles, or a sensor array (e.g., an image sensor) that is positioned above or below the plane of portion 130 to sense an edge of the packaging material. Wrapping apparatus 100 may also include additional components used in connection with other aspects of a wrapping operation. For example, a clamping device 159 may be used to grip the leading end of packaging material 108 between cycles. In addition, a conveyor (not shown) may be used to convey loads to and from wrapping apparatus 100. Other components commonly used on a wrapping apparatus will be appreciated by one of ordinary skill in the art having the benefit of the instant disclosure.

Figure 2:
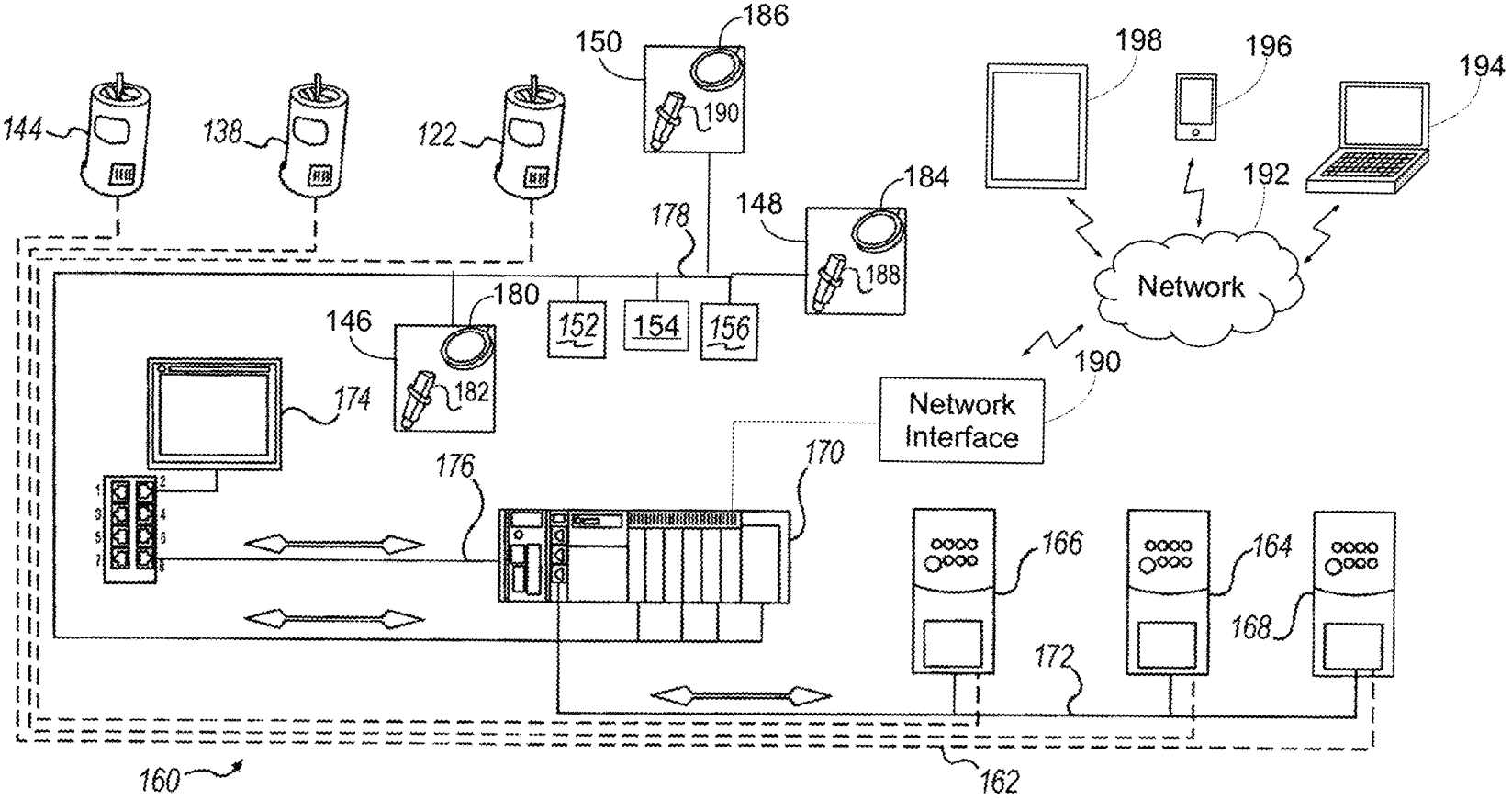
FIG. 2 is a schematic view of an exemplary control system for use in the apparatus of FIG. 1.

An example schematic of a control system 160 for wrapping apparatus 100 is shown in FIG. 2. Motor 122 of packaging material drive system 120, motor 138 of rotational drive system 136, and motor 144 of lift drive system 142 may communicate through one or more data links 162 with a rotational drive variable frequency drive ("VFD") 164, a packaging material drive VFD 166, and a lift drive VFD 168, respectively. Rotational drive VFD 164, packaging material drive VFD 166, and lift drive VFD 168 may communicate with controller 170 through a data link 172. It should be understood that rotational drive VFD 164, packaging material drive VFD 166, and lift drive VFD 168 may produce outputs to controller 170 that controller 170 may use as indicators of rotational movement. For example, packaging material drive VFD 166 may provide controller 170 with signals similar to signals provided by sensor 146, and thus, sensor 146 may be omitted to cut down on manufacturing costs.

Controller 170 in the embodiment illustrated in FIG. 2 is a local controller that is physically co-located with the packaging material drive system 120, rotational drive system 136 and lift drive system 142. Controller 170 may include hardware components and/or software program code that allow it to receive, process, and transmit data. It is contemplated that controller 170 may be implemented as a programmable logic controller (PLC), or may otherwise operate similar to a processor in a computer system. Controller 170 may communicate with an operator interface 174 via a data link 176. Operator interface 174 may include a display or screen and controls that provide an operator with a way to monitor, program, and operate wrapping apparatus 100. For example, an operator may use operator interface 174 to enter or change predetermined and/or desired settings and values, or to start, stop, or pause the wrapping cycle. Controller 170 may also communicate with one or more sensors, e.g., sensors 146, 148, 150, 152, 154 and 156, as well as others not illustrated in FIG. 2, through a data link 178, thus allowing controller 170 to receive performance related data during wrapping. It is contemplated that data links 162, 172, 176, and 178 may include any suitable wired and/or wireless communications media known in the art.

As noted above, sensors 146, 148, 150, 152 may be configured in a number of manners consistent with the invention. In one embodiment, for example, sensor 146 may be configured to sense rotation of downstream dispensing roller 116, and may include one or more magnetic transducers 180 mounted on downstream dispensing roller 116, and a sensing device 182 configured to generate a pulse when the one or more magnetic transducers 180 are brought into proximity of sensing device 182. Alternatively, sensor assembly 146 may include an encoder configured to monitor rotational movement, and capable of producing, for example, 360 or 720 signals per revolution of downstream dispensing roller 116 to provide an indication of the speed or other characteristic of rotation of downstream dispensing roller 116. The encoder may be mounted on a shaft of downstream dispensing roller 116, on electric motor 122, and/or any other suitable area. One example of a sensor assembly that may be used is an Encoder Products Company model 15H optical encoder. Other suitable sensors and/or encoders may be used for monitoring, such as, for example, optical encoders, magnetic encoders, electrical sensors, mechanical sensors, photodetectors, and/or motion sensors.

Likewise, for sensors 148 and 150, magnetic transducers 184, 186 and sensing devices 188, 190 may be used to monitor rotational movement, while for sensor 152, a rotary encoder may be used to determine the angular relationship between the load and packaging material dispenser. Any of the aforementioned alternative sensor configurations may be used for any of sensors 146, 148, 150, 152, 154 and 156 in other embodiments, and as noted above, one or more of such sensors may be omitted in some embodiments. Additional sensors capable of monitoring other aspects of the wrapping operation may also be coupled to controller 170 in other embodiments.

For the purposes of the invention, controller 170 may represent practically any type of computer, computer system, controller, logic controller, or other programmable electronic device, and may in some embodiments be implemented using one or more networked computers or other electronic devices, whether located locally or remotely with respect to the various drive systems 120, 136 and 142 of wrapping apparatus 100.

Controller 170 typically includes a central processing unit including at least one microprocessor coupled to a memory, which may represent the random access memory (RAM) devices comprising the main storage of controller 170, as well as any supplemental levels of memory, e.g., cache memories, non-volatile or backup memories (e.g., programmable or flash memories), read-only memories, etc. In addition, the memory may be considered to include memory storage physically located elsewhere in controller 170, e.g., any cache memory in a processor in CPU 52, as well as any storage capacity used as a virtual memory, e.g., as stored on a mass storage device or on another computer or electronic device coupled to controller 170. Controller 170 may also include one or more mass storage devices, e.g., a floppy or other removable disk drive, a hard disk drive, a direct access storage device (DASD), an optical drive (e.g., a CD drive, a DVD drive, etc.), and/or a tape drive, among others. Furthermore, controller 170 may include an interface 190 with one or more networks 192 (e.g., a LAN, a WAN, a wireless network, and/or the Internet, among others) to permit the communication of information to the components in wrapping apparatus 100 as well as with other computers and electronic devices, e.g. computers such as a single-user desktop computer or laptop computer 194, mobile devices such as a mobile phone 196 or tablet 198, multi-user computers such as servers or cloud resources, etc. Controller 170 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 170, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 170. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

In the discussion hereinafter, the hardware and software used to control wrapping apparatus 100 is assumed to be incorporated wholly within components that are local to wrapping apparatus 100 illustrated in FIGS. 1-2, e.g., within components 162-178 described above. It will be appreciated, however, that in other embodiments, at least a portion of the functionality incorporated into a wrapping apparatus may be implemented in hardware and/or software that is external to the aforementioned components. For example, in some embodiments, some user interaction may be performed using a networked computer or mobile device, with the networked computer or mobile device converting user input into control variables that are used to control a wrapping operation. In other embodiments, user interaction may be implemented using a web-type interface, and the conversion of user input may be performed by a server or a local controller for the wrapping apparatus, and thus external to a networked computer or mobile device. In still other embodiments, a central server may be coupled to multiple wrapping stations to control the wrapping of loads at the different stations. As such, the operations of receiving user input, converting the user input into control variables for controlling a wrap operation, initiating and implementing a wrap operation based upon the control variables, providing feedback to a user, etc., may be implemented by various local and/or remote components and combinations thereof in different embodiments. In this regard, a controller or processor incorporated therein may be configured to interact with an operator interface that is either local to or remote from the controller/processor. In some embodiments, for example, a processor may be implemented within a local controller for a wrapping apparatus, and may cause an operator interface of the wrapping apparatus to display information by directly controlling the local display. In other embodiments, a processor may be implemented within a device that is external to a load wrapping apparatus such as a single-user computer or a mobile device, and may cause an operator interface of the external device to display information by directly controlling the external device display. In still other embodiments, a processor may be implemented within a local controller for a wrapping apparatus or a multi-user computer such as a web server, and may cause an operator interface of a remote device to display information by sending information that is decoded locally on the external device, e.g., through the communication of a web page to a web browser on the external device, or through the communication of information to an application running on the external device. Further, it will be appreciated that in some instances, a processor that determines wrap profiles and/or various wrap parameters may be remote from a wrapping apparatus, and may, for example, communicate such information to a wrapping apparatus and/or to a database for later retrieval by a wrapping apparatus. Additional variations may be contemplated, and as such, the invention is not limited to the particular allocations of functionality described herein.

Figure 3:
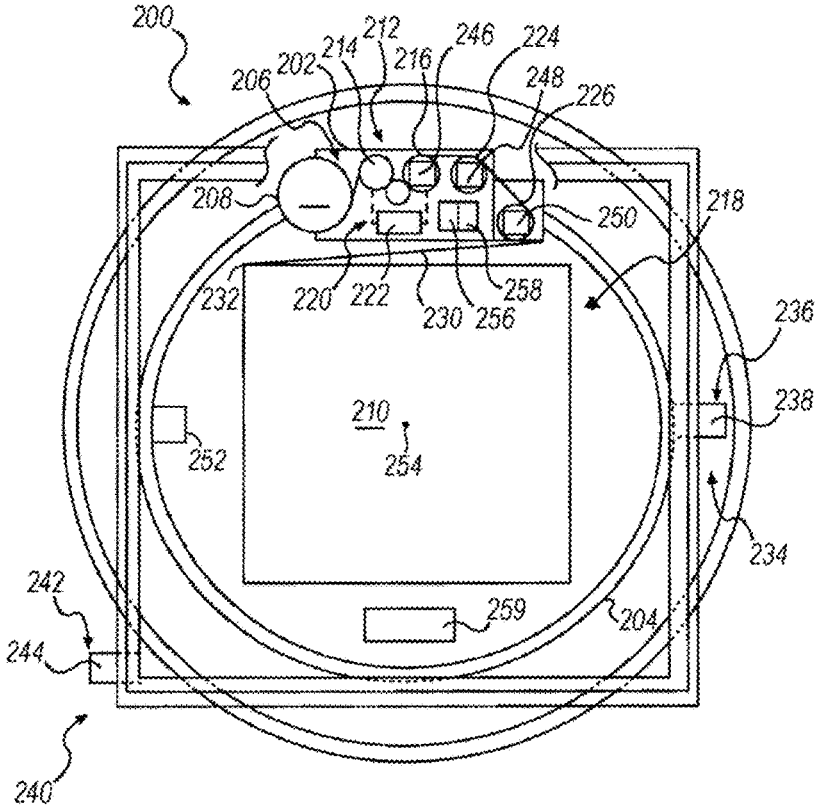
FIG. 3 shows a top view of a rotating ring-type wrapping apparatus consistent with the invention.

Now turning to FIG. 3, a rotating ring-type wrapping apparatus 200 is illustrated. Wrapping apparatus 200 may include elements similar to those shown in relation to wrapping apparatus 100 of FIG. 1, including, for example, a roll carriage 202 including a packaging material dispenser 206 configured to dispense packaging material 208 during relative rotation between roll carriage 202 and a load 210 disposed on a load support 218. However, a rotating ring 204 is used in wrapping apparatus 200 in place of rotating arm 104 of wrapping apparatus 100. In many other respects, however, wrapping apparatus 200 may operate in a manner similar to that described above with respect to wrapping apparatus 100.

Packaging material dispenser 206 may include a pre-stretch assembly 212 including an upstream dispensing roller 214 and a downstream dispensing roller 216, and a packaging material drive system 220, including, for example, an electric motor 222, may be used to drive dispensing rollers 214 and 216. Downstream of downstream dispensing roller 216 may be provided one or more idle rollers 224, 226, with the most downstream idle roller 226 effectively providing an exit point 228 from packaging material dispenser 206, such that a portion 230 of packaging material 208 extends between exit point 228 and a contact point 232 where the packaging material engages load 210.

Wrapping apparatus 200 also includes a relative rotation assembly 234 configured to rotate rotating ring 204, and thus, packaging material dispenser 206 mounted thereon, relative to load 210 as load 210 is supported on load support surface 218. Relative rotation assembly 234 may include a rotational drive system 236, including, for example, an electric motor 238. Wrapping apparatus 200 may further include a lift assembly 240, which may be powered by a lift drive system 242, including, for example, an electric motor 244, that may be configured to move rotating ring 204 and roll carriage 202 vertically relative to load 210.

In addition, similar to wrapping apparatus 100, wrapping apparatus 200 may include sensors 246, 248, 250 on one or more of downstream dispensing roller 216, idle roller 224 and idle roller 226. Furthermore, an angle sensor 252 may be provided for determining an angular relationship between load 210 and packaging material dispenser 206 about a center of rotation 254 (through which projects an axis of rotation that is perpendicular to the view illustrated in FIG. 3), and in some embodiments, one or both of a load distance sensor 256 and a film angle sensor 258 may also be provided. Sensor 252 may be positioned proximate center of rotation 254, or alternatively, may be positioned at other locations, such as proximate rotating ring 204. Wrapping apparatus 200 may also include additional components used in connection with other aspects of a wrapping operation, e.g., a clamping device 259 may be used to grip the leading end of packaging material 208 between cycles.

Figure 4:
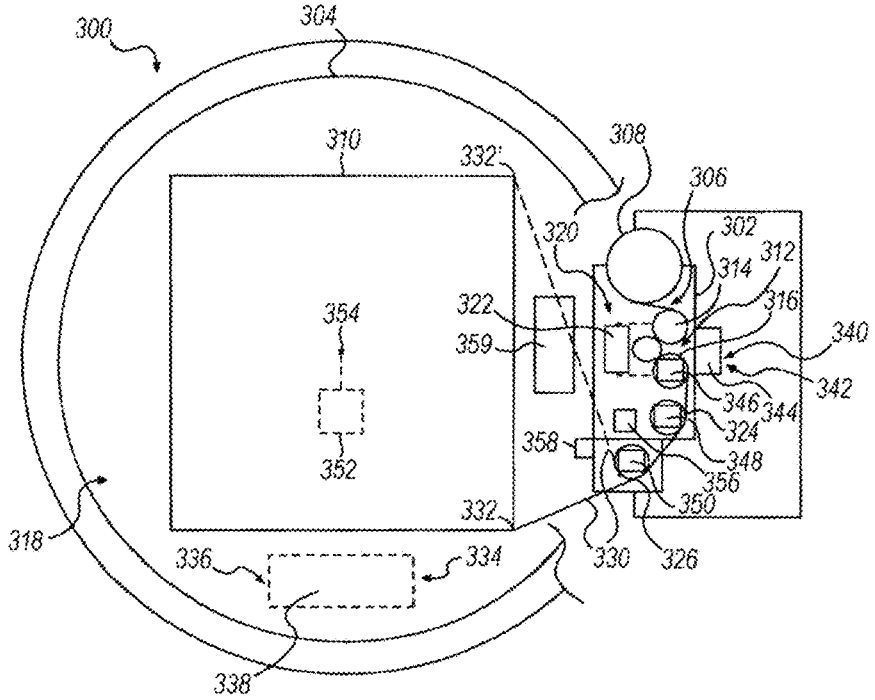
FIG. 4 shows a top view of a turntable-type wrapping apparatus consistent with the invention.

FIG. 4 likewise shows a turntable-type wrapping apparatus 300, which may also include elements similar to those shown in relation to wrapping apparatus 100 of FIG. 1. However, instead of a roll carriage 102 that rotates around a fixed load 110 using a rotating arm 104, as in FIG. 1, wrapping apparatus 300 includes a rotating turntable 304 functioning as a load support 318 and configured to rotate load 310 about a center of rotation 354 (through which projects an axis of rotation that is perpendicular to the view illustrated in FIG. 4) while a packaging material dispenser 306 disposed on a dispenser support 302 remains in a fixed location about center of rotation 354 while dispensing packaging material 308. In many other respects, however, wrapping apparatus 300 may operate in a manner similar to that described above with respect to wrapping apparatus 100.

Packaging material dispenser 306 may include a pre-stretch assembly 312 including an upstream dispensing roller 314 and a downstream dispensing roller 316, and a packaging material drive system 320, including, for example, an electric motor 322, may be used to drive dispensing rollers 314 and 316, and downstream of downstream dispensing roller 316 may be provided one or more idle rollers 324, 326, with the most downstream idle roller 326 effectively providing an exit point 328 from packaging material dispenser 306, such that a portion 330 of packaging material 308 extends between exit point 328 and a contact point 332 (or alternatively contact point 332' if load 310 is rotated in a counter-clockwise direction) where the packaging material engages load 310.

Wrapping apparatus 300 also includes a relative rotation assembly 334 configured to rotate turntable 304, and thus, load 310 supported thereon, relative to packaging material dispenser 306. Relative rotation assembly 334 may include a rotational drive system 336, including, for example, an electric motor 338. Wrapping apparatus 300 may further include a lift assembly 340, which may be powered by a lift drive system 342, including, for example, an electric motor 344, that may be configured to move dispenser support 302 and packaging material dispenser 306 vertically relative to load 310.

In addition, similar to wrapping apparatus 100, wrapping apparatus 300 may include sensors 346, 348, 350 on one or more of downstream dispensing roller 316, idle roller 324 and idle roller 326. Furthermore, an angle sensor 352 may be provided for determining an angular relationship between load 310 and packaging material dispenser 306 about a center of rotation 354, and in some embodiments, one or both of a load distance sensor 356 and a film angle sensor 358 may also be provided. Sensor 352 may be positioned proximate center of rotation 354, or alternatively, may be positioned at other locations, such as proximate the edge of turntable 304. Wrapping apparatus 300 may also include additional components used in connection with other aspects of a wrapping operation, e.g., a clamping device 359 may be used to grip the leading end of packaging material 308 between cycles.

Each of wrapping apparatus 200 of FIG. 3 and wrapping apparatus 300 of FIG. 4 may also include a controller (not shown) similar to controller 170 of FIG. 2, and receive signals from one or more of the aforementioned sensors and control packaging material drive system 220, 320 during relative rotation between load 210, 310 and packaging material dispenser 206, 306.

Those skilled in the art will recognize that the example environments illustrated in FIGS. 1-4 are not intended to limit the present invention. Indeed, those skilled in the art will recognize that other alternative environments may be used without departing from the scope of the invention.

Wrapping Operation

During a typical wrapping operation, a clamping device, e.g., as known in the art, is used to position a leading edge of the packaging material on the load such that when relative rotation between the load and the packaging material dispenser is initiated, the packaging material will be dispensed from the packaging material dispenser and wrapped around the load. In addition, where prestretching is used, the packaging material is stretched prior to being conveyed to the load. The dispense rate of the packaging material is controlled during the relative rotation between the load and the packaging material, and a lift assembly controls the position, e.g., the height, of the web of packaging material engaging the load so that the packaging material is wrapped in a spiral manner around the load from the base or bottom of the load to the top. Multiple layers of packaging material may be wrapped around the load over multiple passes to increase overall containment force, and once the desired amount of packaging material is dispensed, the packaging material is severed to complete the wrap.

In the illustrated embodiments, to control the overall containment force of the packaging material applied to the load, both the wrap force and the position of the web of packaging material are both controlled to provide the load with a desired overall containment force. The mechanisms by which each of these aspects of a wrapping operation are controlled are provided below.

Wrap Force Control

In many wrapping applications, the rate at which packaging material is dispensed by a packaging material dispenser of a wrapping apparatus is controlled based on a desired payout percentage, which in general relates to the amount of wrap force applied to the load by the packaging material during wrapping. Further details regarding the concept of payout percentage may be found, for example, in the aforementioned U.S. Pat. No. 7,707,801, which has been incorporated by reference.

In many embodiments, for example, a payout percentage may have a range of about 80% to about 120%. Decreasing the payout percentage slows the rate at which packaging material exits the packaging material dispenser compared to the relative rotation of the load such that the packaging material is pulled tighter around the load, thereby increasing wrap force, and as a consequence, the overall containment force applied to the load. In contrast, increasing the payout percentage decreases the wrap force. For the purposes of simplifying the discussion hereinafter, however, a payout percentage of 100% is initially assumed.

It will be appreciated, however, that other metrics may be used as an alternative to payout percentage to reflect the relative amount of wrap force to be applied during wrapping, so the invention is not so limited. In particular, to simplify the discussion, the term "wrap force" will be used herein to generically refer to any metric or parameter in a wrapping apparatus that may be used to control how tight the packaging material is pulled around a load at a given instant. Wrap force, as such, may be based on the amount of tension induced in a web of packaging material extending between the packaging material dispenser and the load, which in some embodiments may be measured and controlled directly, e.g., through the use of an electronic load cell coupled to a roller over which the packaging material passes, a spring-loaded dancer interconnected with a sensor, a torque control device, or any other suitable sensor capable of measuring force or tension in a web of packaging material.

On the other hand, because the amount of tension that is induced in a web of packaging material is fundamentally based upon the relationship between the feed rate of the packaging material and the rate of relative rotation of the load (i.e., the demand rate of the load), wrap force may also refer to various metrics or parameters related to the rate at which the packaging material is dispensed by a packaging material dispenser.

Thus, a payout percentage, which relates the rate at which the packaging material is dispensed by the packaging material dispenser to the rate at which the load is rotated relative to the packaging material dispenser, may be a suitable wrap force parameter in some embodiments. Alternatively, a dispense rate, e.g., in terms of the absolute or relative linear rate at which packaging material exits the packaging material dispenser, or the absolute or relative rotational rate at which an idle or driven roller in the packaging material dispenser or otherwise engaging the packaging material rotates, may also be a suitable wrap force parameter in some embodiments.

To control wrap force in a wrapping apparatus, a number of different control methodologies may be used. For example, in some embodiments of the invention, the effective circumference of a load may be used to dynamically control the rate at which packaging material is dispensed to a load when wrapping the load with packaging material during relative rotation established between the load and a packaging material dispenser, and thus control the wrap force applied to the load by the packaging material, e.g., as disclosed in U.S. Pat. No. 10,005,581, which is incorporated by reference herein.

Web Position Control

Figure 5:
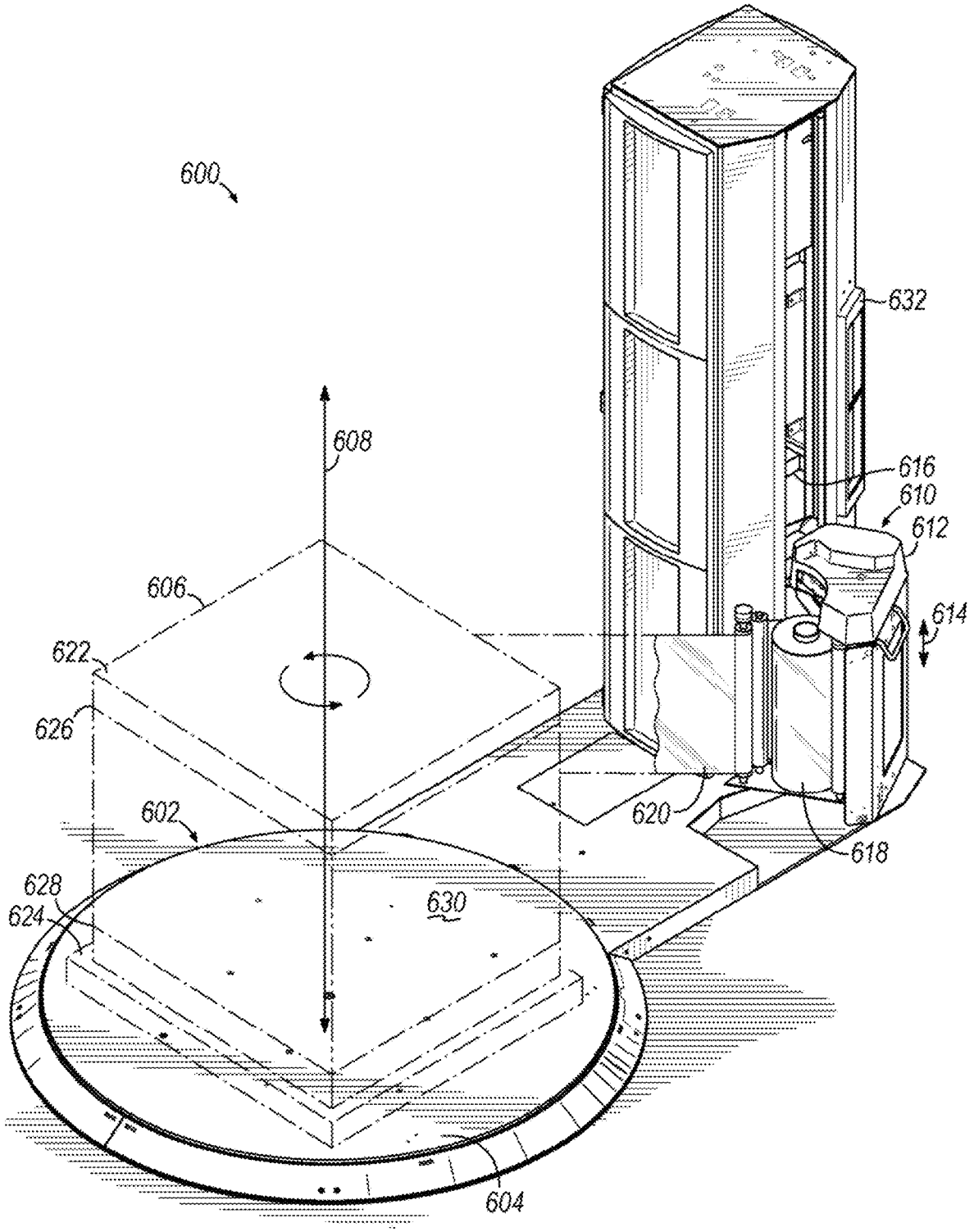
FIG. 5 is a perspective view of a turntable-type wrapping apparatus consistent with the invention.

As noted above, during a wrapping operation, the position of the web of packaging material is typically controlled to wrap the load in a spiral manner. FIG. 5, for example, illustrates a turntable-type wrapping apparatus 600 similar to wrapping apparatus 300 of FIG. 4, including a load support 602 configured as a rotating turntable 604 for supporting a load 606. Turntable 604 rotates about an axis of rotation 608, e.g., in a counter-clockwise direction as shown in FIG. 5.

A packaging material dispenser 610, including a roll carriage 612, is configured for movement along a direction 614 by a lift mechanism 616. Roll carriage 612 supports a roll 618 of packaging material, which during a wrapping operation includes a web 620 extending between packaging material dispenser 610 and load 606.

Direction 614 is generally parallel to an axis about which packaging material is wrapped around load 606, e.g., axis 608, and movement of roll carriage 612, and thus web 620, along direction 614 during a wrapping operation enables packaging material to be wrapped spirally around the load.

In the illustrated embodiment, it is desirable to provide at least a minimum number of layers of packaging material within a contiguous region on a load. For example, load 606 includes opposing ends along axis 608, e.g., a top 622 and bottom 624 for a load wrapped about a vertically oriented axis 608, and it may be desirable to wrap packaging material between two positions 626 and 628 defined along direction 614 and respectively proximate top 622 and bottom 624. Positions 626, 628 define a region 630 therebetween that, in the illustrated embodiments, is provided with at least a minimum number of layers of packaging material throughout.

The position of roll carriage 612 may be sensed using a sensing device (not shown in FIG. 5), which may include any suitable reader, encoder, transducer, detector, or sensor capable of determining the position of the roll carriage, another portion of the packaging material dispenser, or of the web of packaging material itself relative to load 606 along direction 614. It will be appreciated that while a vertical direction 614 is illustrated in FIG. 5, and thus the position of roll carriage 612 corresponds to a height, in other embodiments where a load is wrapped about an axis other than a vertical axis, the position of the roll carriage may not be related to a height.

Control of the position of roll carriage 612, as well as of the other drive systems in wrapping apparatus 600, is provided by a controller 632, the details of which are discussed in further detail below.

Containment Force-Based Wrapping

Conventionally, stretch wrapping machines have controlled the manner in which packaging material is wrapped around a load by offering control input for the number of bottom wraps placed at the base of a load, the number of top wraps placed at the top of the load, and the speed of the roll carriage in the up and down traverse to manage overlaps of the spiral wrapped film. In some designs, these controls have been enhanced by controlling the overlap inches during the up and down travel taking into consideration the relative speed of rotation and roll carriage speed.

However, it has been found that conventional control inputs often do not provide optimal performance, as such control inputs often do not evenly distribute the containment forces on all areas of a load, and often leave some areas with insufficient containment force. Often, this is due to the relatively complexity of the control inputs and the need for experienced operators. Particularly with less experienced operators, operators react to excessive film breaks by reducing wrap force and inadvertently lowering cumulative containment forces below desirable levels.

Some embodiments consistent with the invention, on the other hand, utilize a containment force-based wrap control to simplify control over wrap parameters and facilitate even distribution of containment force applied to a load. In particular, in some embodiments of the invention, an operator specifies a load containment force requirement that is used, in combination with one or more attributes of the packaging material being used to wrap the load, to control the dispensing of packaging material to the load.

A load containment force requirement, for example, may include a minimum overall containment force to be applied over all concerned areas of a load (e.g., all areas over which packaging material is wrapped around the load). In some embodiments, a load containment force requirement may also include different minimum overall containment forces for different areas of a load, a desired range of containment forces for some or all areas of a load, a maximum containment force for some or all areas of a load.

A packaging material attribute may include, for example, an incremental containment force/revolution (ICF) attribute, which is indicative of the amount of containment force added to a load in a single revolution of packaging material around the load, and which in some embodiments may be implemented as an ICF function. The ICF attribute may be related to a wrap force or payout percentage, such that, for example, the ICF attribute is defined as a function of the wrap force or payout percentage at which the packaging material is being applied. In some embodiments, the ICF attribute may be linearly related to payout percentage, and include an incremental containment force at 100% payout percentage along with a slope that enables the incremental containment force to be calculated for any payout percentage. Alternatively, the ICF attribute may be defined with a more complex function, e.g., s-curve, interpolation, piecewise linear, exponential, multi-order polynomial, logarithmic, moving average, power, or other regression or curve fitting techniques. It will be appreciated that other attributes associated with the tensile strength of the packaging material may be used in the alternative.

Other packaging material attributes may include attributes associated with the thickness and/or weight of the packaging material, e.g., specified in terms of weight per unit length, such as weight in ounces per 1000 inches. Still other packaging material attributes may include a wrap force limit attribute, indicating, for example, a maximum wrap force or range of wrap forces with which to use the packaging material (e.g., a minimum payout percentage), a width attribute indicating the width (e.g., in inches) of the packaging material, and/or additional identifying attributes of a packaging material (e.g., manufacturer, model, composition, coloring, etc.), among others.

A load containment force requirement and a packaging material attribute may be used in a wrap control consistent with the invention to determine one or both of a wrap force to be used when wrapping a load with packaging material and a number of layers of packaging material to be applied to the load to meet the load containment force requirement. The wrap force and number of layers may be represented respectively by wrap force and layer parameters. The wrap force parameter may specify, for example, the desired wrap force to be applied to the load, e.g., in terms of payout percentage, or in terms of a dispense rate or force.

The layer parameter may specify, for example, a minimum number of layers of packaging material to be dispensed throughout a contiguous region of a load. In this regard, a contiguous region of a load may refer to a region of a load between two different relative elevations along an axis of relative rotation and throughout which it is desirable to apply packaging material. In some embodiments, the contiguous region may be considered to include all sides of a load, while in other embodiments, the contiguous region may refer to only a single side or subset of sides, or even to a line extending along a side of a load between different elevations.

With regard to the concept of a minimum number of layers of packaging material, a minimum number of layers of three, for example, means that at any point on the load within a contiguous region wrapped with packaging material, at least three overlapping layers of packaging material will overlay that point. Put differently, the number of layers may also be considered to represent a combined thickness of packaging material applied to the load. As such, in some embodiments, the layer parameter may be specified in terms of a minimum combined thickness of packaging material to be dispensed through a contiguous region of a load. In some embodiments, the combined thickness may be represented in terms of layers, while in other embodiments, the combined thickness may be represented in terms of the actual packaging material thickness represented by the combined layers of packaging material applied to the load. Nonetheless, for the purposes of this disclosure, the terms "number of layers" and "combined thickness" may be used interchangeably.

In addition, while a layer parameter in the embodiments hereinafter is based upon a minimum value throughout a contiguous region of a load, in other embodiments, a layer parameter may be based on an average, median or other calculation related to the combined thickness of packaging material throughout at least a portion of the contiguous region.

Moreover, it will be appreciated that a layer parameter may specify other control parameters that, when utilized, provide the desired minimum number of layers or combined thickness, e.g., an amount of overlap between successive revolutions, a carriage or elevator speed, a number of up and/or down passes of the carriage or elevator, a number of relative revolutions, etc. For example, in some embodiments, carriage speed and the number of up and/or down passes may be used as layer parameters to provide a desired minimum number of layers or combined thickness of packaging material during a wrapping operation. In some other embodiments, however, no separate determination of minimum number of layers or combined thickness may be performed, and layer parameters based on overlap, carriage speed and/or number of passes may be used.

A layer parameter may also specify different number of layers for different portions of a load, and may include, for example, additional layers proximate the top and/or bottom of a load. Other layer parameters may include banding parameters (e.g., where multiple pallets are stacked together in one load).

Figure 6:
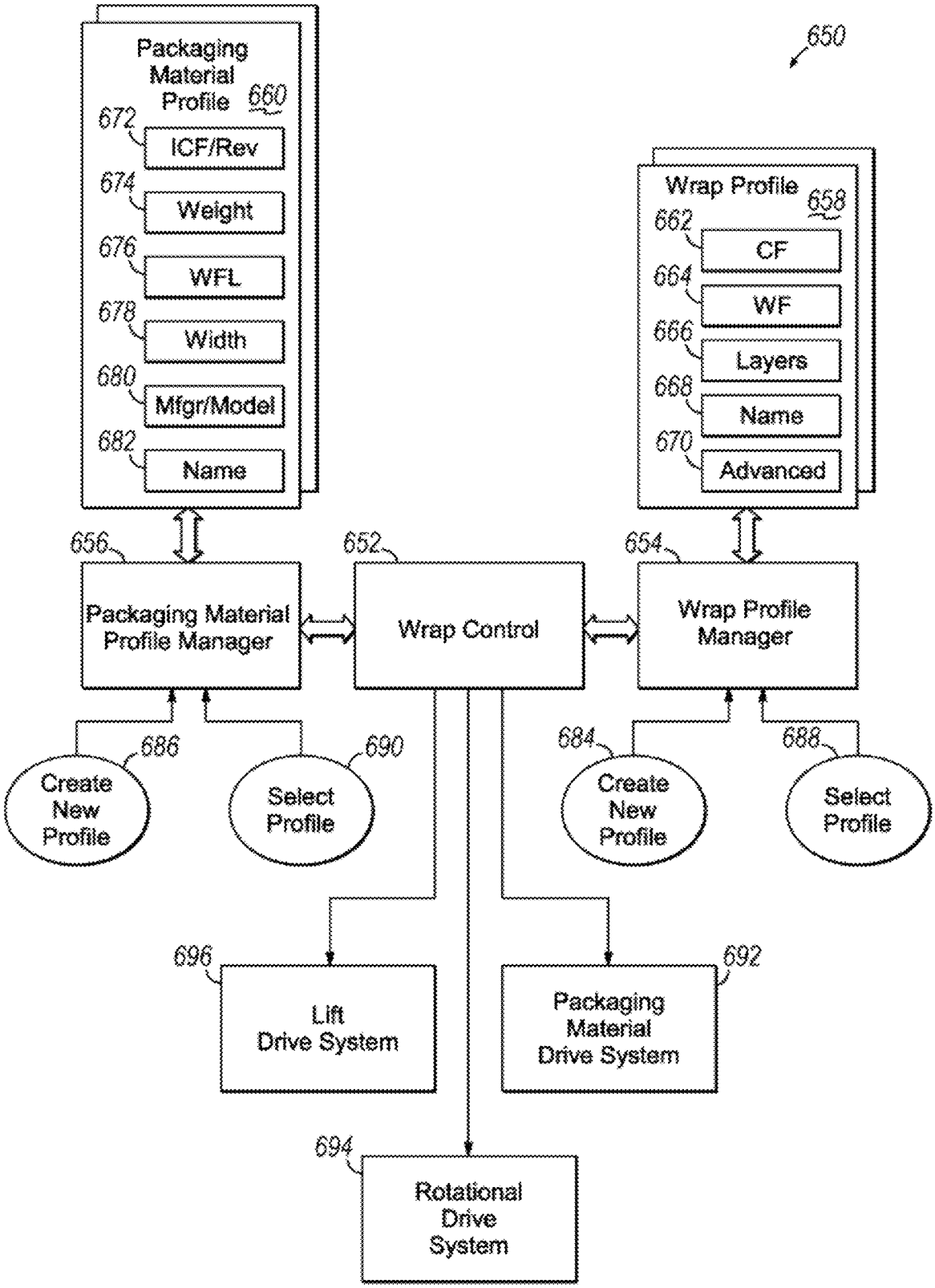
FIG. 6 is a block diagram illustrating an example load containment force-based control system consistent with the invention.

Now turning to FIG. 6, an example control system 650 for a wrapping apparatus implements load containment force-based wrap control through the use of profiles. In particular, a wrap control block 652 is coupled to a wrap profile manager block 654 and a packaging material profile manager block 656, which respectively manage a plurality of wrap profiles 658 and packaging material profiles 660.

Each wrap profile 658 stores a plurality of parameters, including, for example, a containment force parameter 662, a wrap force (or payout percentage) parameter 664, and a layer parameter 666. In addition, each wrap profile 658 may include a name parameter providing a name or other identifier for the profile. The name parameter may identify, for example, a type of load (e.g., a light stable load type, a moderate stable load type, a moderate unstable load type or a heavy unstable load type), or may include any other suitable identifier fora load (e.g., "20 oz bottles", "Acme widgets", etc.).

In addition, a wrap profile may include additional parameters, collectively illustrated as advanced parameters 670, that may be used to specify additional instructions for wrapping a load. Additional parameters may include, for example, an overwrap parameter identifying the amount of overwrap on top of a load, a top parameter specifying an additional number of layers to be applied at the top of the load, a bottom parameter specifying additional number of layers to be applied at the bottom of the load, a pallet payout parameter specifying the payout percentage to be used to wrap a pallet supporting the load, a top wrap first parameter specifying whether to apply top wraps before bottom wraps, a variable load parameter specifying that loads are the same size from top to bottom, a variable layer parameter specifying that loads are not the same size from top to bottom, one or more rotation speed parameters (e.g., one rotation speed parameter specifying a rotational speed prior to a first top wrap and another rotation speed parameter specifying a rotational speed after the first top wrap), a band parameter specifying any additional layers to be applied at a band position, a band position parameter specifying a position of the band from the down limit, a load lift parameter specifying whether to raise the load with a load lift, a short parameter specifying a height to wrap for short loads (e.g., for loads that are shorter than a height sensor), etc.

A packaging material profile 660 may include a number of packaging material-related attributes and/or parameters, including, for example, an incremental containment force/revolution attribute 672 (which may be represented, for example, by a slope attribute and a force attribute at a specified wrap force), a weight attribute 674, a wrap force limit attribute 676, and a width attribute 678. In addition, a packaging material profile may include additional information such as manufacturer and/or model attributes 680, as well as a name attribute 682 that may be used to identify the profile. Other attributes, such as cost or price attributes, roll length attributes, prestretch attributes, or other attributes characterizing the packaging material, may also be included.

Each profile manager 654, 656 supports the selection and management of profiles in response to user input, e.g., from an operator of the wrapping apparatus. For example, each profile manager may receive user input 684, 686 to create a new profile, as well as user input 688, 690 to select a previously-created profile. Additional user input, e.g., to modify or delete a profile, duplicate a profile, etc. may also be supported. Furthermore, it will be appreciated that user input may be received in a number of manners consistent with the invention, e.g., via a touchscreen, via hard buttons, via a keyboard, via a graphical user interface, via a text user interface, via a computer or controller coupled to the wrapping apparatus over a wired or wireless network, etc.

In addition, wrap and packaging material profiles may be stored in a database or other suitable storage, and may be created using control system 650, imported from an external system, exported to an external system, retrieved from a storage device, etc. In some instances, for example, packaging material profiles may be provided by packaging material manufacturers or distributors, or by a repository of packaging material profiles, which may be local or remote to the wrapping apparatus. Alternatively, packaging material profiles may be generated via testing, e.g., as disclosed in the aforementioned U.S. Patent Application Publication No. 2012/0102886.

A load wrapping operation using control system 650 may be initiated, for example, upon selection of a wrap profile 658 and a packaging material profile 660, and results in initiation of a wrapping operation through control of a packaging material drive system 692, rotational drive system 694, and lift drive system 696.

Furthermore, wrap profile manager 654 includes functionality for automatically calculating one or more parameters in a wrap profile based upon a selected packaging material profile and/or one or more other wrap profile parameters. For example, wrap profile manager 654 may be configured to calculate a layer parameter and/or a wrap force parameter for a wrap profile based upon the load containment force requirement for the wrap profile and the packaging material attributes in a selected packaging material profile. In addition, in response to modification of a wrap profile parameter and/or selection of a different packaging material profile, wrap profile manager 654 may automatically update one or more wrap profile parameters.

In one embodiment, for example, selection of a different packaging material profile may result in updating of a layer and/or wrap force parameter for a selected wrap profile. In another embodiment, selection of a different wrap force parameter may result in updating of a layer parameter, and vice versa.

As one example, in response to unacceptable increases in film breaks, film quality issues, or mechanical issues such as film clamps or prestretch roller slippage, an operator may reduce wrap force (i.e., increase payout percentage), and functionality in the wrap control system may automatically increase the layer parameter to maintain the overall load containment force requirement for the wrap profile.

Wrap profile manager 654 may also support functionality for comparing different packaging material profiles, e.g., to compare the performance and/or cost of different packaging materials. An operator may therefore be able to determine, for example, that one particular packaging material, which has a lower cost per roll than another packaging material, is actually more expensive due to a need for additional layers to be applied to maintain a sufficient overall containment force. In some embodiments, a packaging material profile may even be automatically selected from among a plurality of packaging material profiles based upon comparative calculations to determine what packaging materials provide the desired performance with the lowest overall cost.

Figure 7:
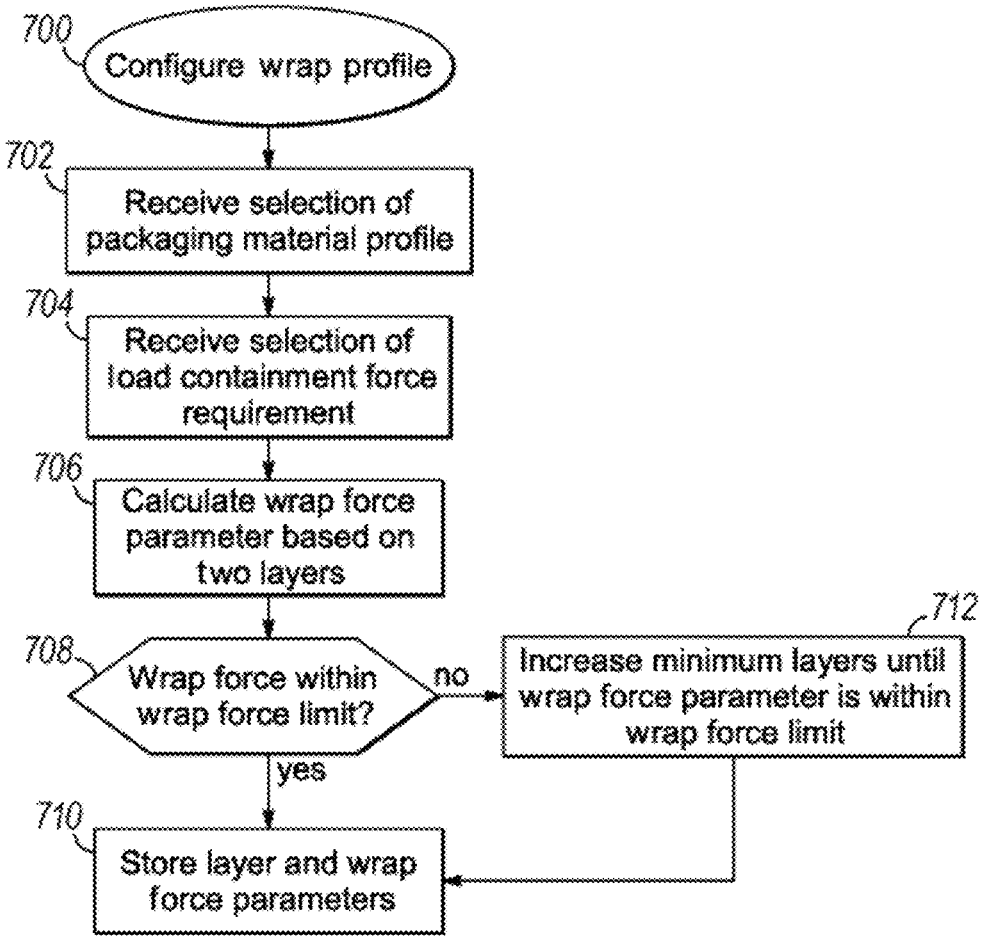
FIG. 7 is a flowchart illustrating a sequence of steps in an example routine for configuring a wrap profile in the control system of FIG. 6.

FIG. 7 illustrates an example routine 700 for configuring a wrap profile using wrap control system 650. Routine 700 begins in block 702 by receiving an operator selection of a packaging material profile. Next, in block 704, an operator selection of a load containment force requirement, e.g., a minimum load containment force, is received.

In some embodiments, a load containment force requirement may be specified based on a numerical force (e.g., in pounds of force). In other embodiments, the requirement may be based on a load attribute, such as a load type and/or various load-related characteristics. In some embodiments, for example, loads may be classified as being light, moderate or heavy, and stable or unstable in nature, and an appropriate load containment force requirement may be calculated based upon the load type or attributes. In still other embodiments, an operator may be provided with recommended ranges of containment forces, e.g., 2-5 lbs for light stable loads, 5-7 lbs for moderate stable loads, 7-12 lbs for moderate unstable loads, and 12-20 lbs for heavy unstable loads, enabling an operator to input a numerical containment force based upon the recommended ranges.

Next, in block 706, a wrap force parameter, e.g., a payout percentage, is calculated assuming an initial layer parameter of a minimum of two layers, and based on an incremental containment force/revolution attribute of the selected packaging material profile. The overall load containment force (CF) is calculated as:

$$CF=ICF*L \tag{10}$$

where ICF is the incremental containment force/revolution of the packaging material and L is the layer parameter, which is initially set to two.

The ICF attribute, as noted above, may be specified based on a containment force at a predetermined wrap force/payout percentage and a slope. Thus, for example, assuming an incremental containment force at 100% payout percentage ($ICF_{100\%}$) and slope (S), the ICF attribute is calculated as:

$$ICF=ICF_{100\%}+S(PP-100\%) \tag{11}$$

where PP is the wrap force or payout percentage.

Based on equations (10) and (11), wrap force, or payout percentage (PP) is calculated from the overall load containment force, the ICF attribute and the layer parameter as follows:

$$PP = 100\% + \frac{\left(\frac{CF}{L} - ICF_{100\%}\right)}{S} \tag{12}$$

Next, block 708 determines whether the payout percentage is within the wrap force limit for the packaging material. If so, control passes to block 710 to store the layer (L) and wrap force (PP) parameters for the wrap profile, and configuration of the wrap profile is complete. Otherwise, block 708 passes control to block 712 to increase the layer (L) parameter until the wrap force (PP) parameter as calculated using equation (12) falls within the wrap force limit for the packaging material. Control then passes to block 710 to store the layer and wrap force parameters. In this way, the overall load containment force requirement is met using the least number of layers, which minimizes costs and cycle time for a wrapping operation.

It will be appreciated that the functionality described above for routine 700 may also be used in connection with modifying a wrap profile, e.g., in response to an operator changing the number of layers, the selected packaging material profile, the desired wrap force and/or the overall load containment force requirement for a wrap profile. In addition, in other embodiments, no preference for using the least number of layers may exist, such that the selection of a layer and/or wrap force parameter may be based on whichever combination of parameters that most closely match the overall load containment force requirement for a load.

Figure 8:
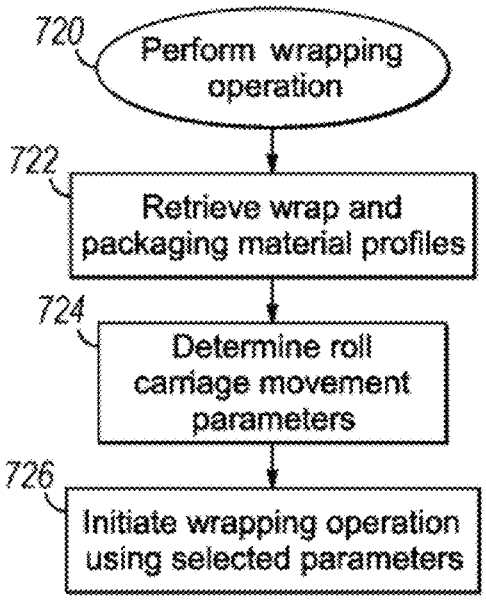
FIG. 8 is a flowchart illustrating a sequence of steps in an example routine for performing a wrapping operation in the control system of FIG. 6.

Once a wrap profile has been selected by an operator, a wrapping operation may be initiated, e.g., using a sequence of steps such as illustrated by routine 720 in FIG. 8. In particular, in block 722 the selected wrap and packaging material profiles are retrieved, and then in block 724, one or more roll carriage parameters are determined. The roll carriage parameters generally control the movement of the roll carriage, and thus, the height where the web of packaging material engages the load during a wrapping operation, such that the selected minimum number of layers of packaging material are applied to the load throughout a desired contiguous region of the load.

For example, in one embodiment, the roll carriage parameters may include a speed or rate of the roll carriage during a wrapping operation, as the number of layers applied by a wrapping operation may be controlled in part by controlling the speed or rate of the roll carriage as it travels between top and bottom positions relative to the rotational speed of the load. The rate may further be controlled based on a desired overlap between successive revolutions or wraps of the packaging material, as the overlap (O) may be used to provide the desired number of layers (L) of a packaging material having a width (W) based on the relationship:

$$O = W - \frac{W}{L} \tag{13}$$

In some instances, however, it may be desirable to utilize multiple up and/or down passes of the roll carriage in a wrapping operation such that only a subset of the desired layers is applied in each pass, and as such, the roll carriage parameters may also include a number of up and/or down passes.

In some embodiments, for example, such as some vertical ring designs, it may be desirable to attempt to apply all layers in a single pass between the top and bottom of a load. In other designs, however, such as designs incorporating bottom mounted clamping devices, it may be desirable to perform a first pass from the bottom to the top of the load and a second pass from the top of the load to the bottom of the load. In one embodiment for the latter type of designs, for example, two layers may be applied by applying the first layer on the first pass using an overlap of 0 inches and applying the second layer on the second pass using an overlap of 0 inches. Three layers may be applied by applying the first and second layers on the first pass using an overlap of 50% of the packaging width and applying the third layer on the second pass using an overlap of 0 inches. Four layers may be applied by applying the first and second layers on the first pass and the third and fourth layers on the second path, all with an overlap of 50% of the packaging material width. Five layers may be applied by applying the first, second and third layers on the first pass with an overlap of 67% of the packaging material width and applying the fourth and fifth layers on the second pass with an overlap of 50% of the packaging material width, etc.

It will be appreciated, however, the calculation of a roll carriage rate to provide the desired overlap and minimum number of layers throughout a contiguous region of the load may vary in other embodiments, and may additionally account for additional passes, as well as additional advanced parameters in a wrap profile, e.g., the provision of bands, additional top and/or bottom layers, pallet wraps, etc. In addition, more relatively complex patterns of movement may be defined for a roll carriage to vary the manner in which packaging material is wrapped around a load in other embodiments of the invention.

Returning to FIG. 8, after determination of the roll carriage parameters, block 726 initiates a wrapping operation using the selected parameters. During the wrapping operation, the movement of the roll carriage is controlled based upon the determined roll carriage parameters, and the wrap force is controlled in the manner discussed above based on the wrap force parameter in the wrap profile. In this embodiment, the load height is determined after the wrapping operation is initiated, e.g., using a sensor coupled to the roll carriage to sense when the top of the load has been detected during the first pass of the roll carriage. Alternatively, the load height may be defined in a wrap profile, may be manually input by an operator, or may be determined prior to initiation of a wrapping operation using a sensor on the wrapping apparatus. In addition, other parameters in the profile or otherwise stored in the wrap control system (e.g., the top and/or bottom positions for roll carriage travel relative to load height, band positions and layers, top and/or bottom layers, etc.), may also be used in the performance of the wrapping operation.

It will be appreciated that in other embodiments, no profiles may be used, whereby control parameters may be based on individual parameters and/or attributes input by an operator. Therefore, the invention does not require the use of profiles in all embodiments. In still other embodiments, an operator may specify one parameter, e.g., a desired number of layers, and a wrap control system may automatically select an appropriate wrap force parameter, packaging material and/or load containment force requirement based upon the desired number of layers.

Figure 9:
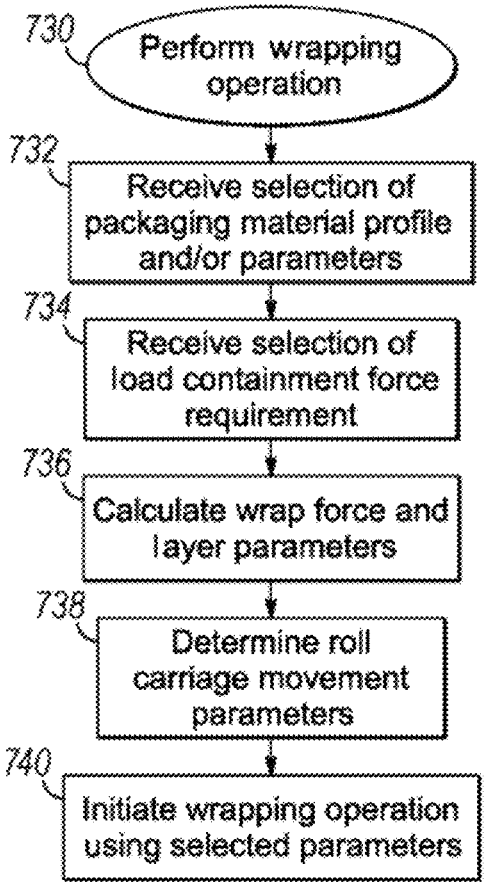
FIG. 9 is a flowchart illustrating a sequence of steps in an example routine for performing another wrapping operation in the control system of FIG. 6, but based upon operator input of a load containment force requirement.

For example, FIG. 9 illustrates an alternate routine 730 in which an operator inputs packaging material parameters either via a packaging material profile or through the manual input of one or more packaging material parameters (block 732), along with the input of a load containment force requirement (block 734). The input of the load containment force requirement may include, for example, selection of a numerical indicator of load containment force (e.g., 10 lbs). Alternatively, the input of the load containment force requirement may include the input of one or more load types, attributes or characteristics (e.g., weight of load, stability of load, a product number or identifier, etc.), with a wrap control system selecting an appropriate load containment force for the type of load indicated.

Then, in block 736, wrap force and layer parameters are determined in the manner disclosed above based on the load containment force requirement and packaging material attributes, and thereafter, roll carriage movement parameters are determined (block 738) and a wrapping operation is initiated to wrap the determined number of layers on the load using the determined wrap force (block 740). As such, an operator is only required to input characteristics of the load and/or an overall load containment force, and based on the packaging material used, suitable control parameters are generated to control the wrapping operation. Thus, the level of expertise required to operate the wrapping apparatus is substantially reduced.

Figure 10:
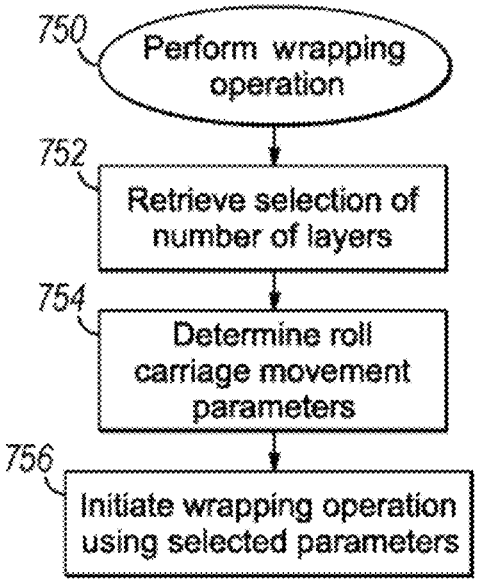
FIG. 10 is a flowchart illustrating a sequence of steps in an example routine for performing another wrapping operation in the control system of FIG. 6, but based upon operator input of a number of layers of packaging material to apply to a load.

As another example, FIG. 10 illustrates a routine 750 that is similar to routine 720 of FIG. 8, but that includes the retrieval of a selection of the number of layers to be applied from an operator in block 752, e.g., via user input that selects a numerical number of layers. Once the number of layers has been selected by an operator, and then based upon the width of the packaging material, and the number of layers defined in the wrap profile, as well as any additional parameters in the profile or otherwise stored in the wrap control system (e.g., the top and/or bottom positions for roll carriage travel relative to load height, band positions and layers, top and/or bottom layers, etc.), one or more roll carriage parameters may be determined in block 754, in a similar manner as that described above in connection with FIG. 8. Then, after determination of the roll carriage parameters, block 756 initiates a wrapping operation using the selected parameters. During the wrapping operation, the movement of the roll carriage is controlled based upon the determined roll carriage parameters. In addition, the wrap force may be controlled in the manner discussed above based on a wrap force parameter. Alternatively, various alternative wrap force controls, e.g., various conventional wrap force controls, may be used, with the operator selection of the number of layers used to control the manner in which the packaging material is wrapped about the load.

Additional details, such as touch screen displays suitable for implementing the aforementioned routines, as well as techniques for profiling packaging material, are described in the aforementioned '863 and '864 published applications referenced above. In addition, various control methodologies based upon load stability, e.g., as disclosed in the aforementioned U.S. Publication No. 2016/0096646, which is incorporated by reference herein, may also be used in some embodiments.

Packaging Material Grading and Factory Profiles

Figure 11:
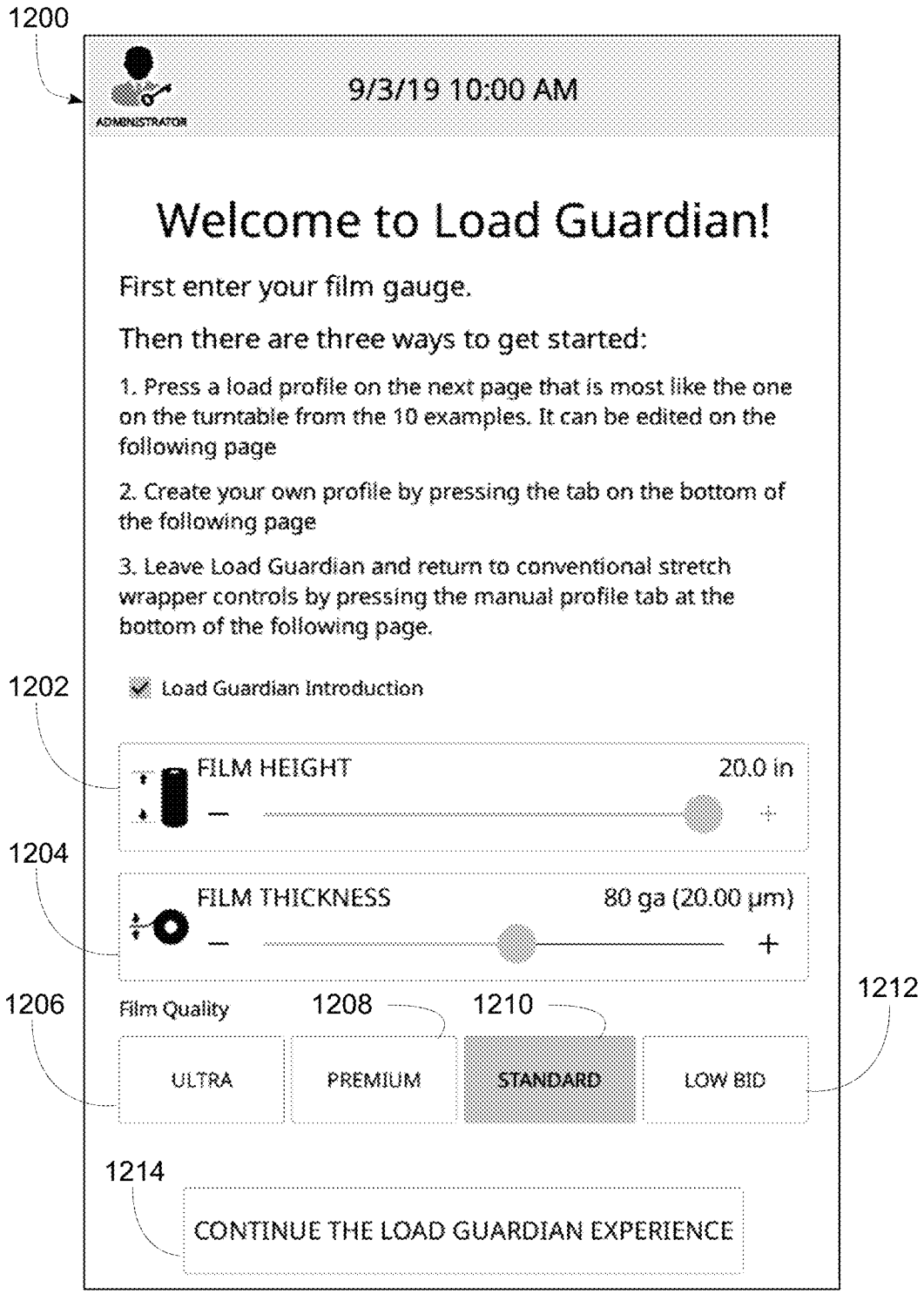
FIGS. 11-13 are block diagrams of example displays capable of being displayed by the control system of FIG. 6 when interacting with an operator.
Figure 12:
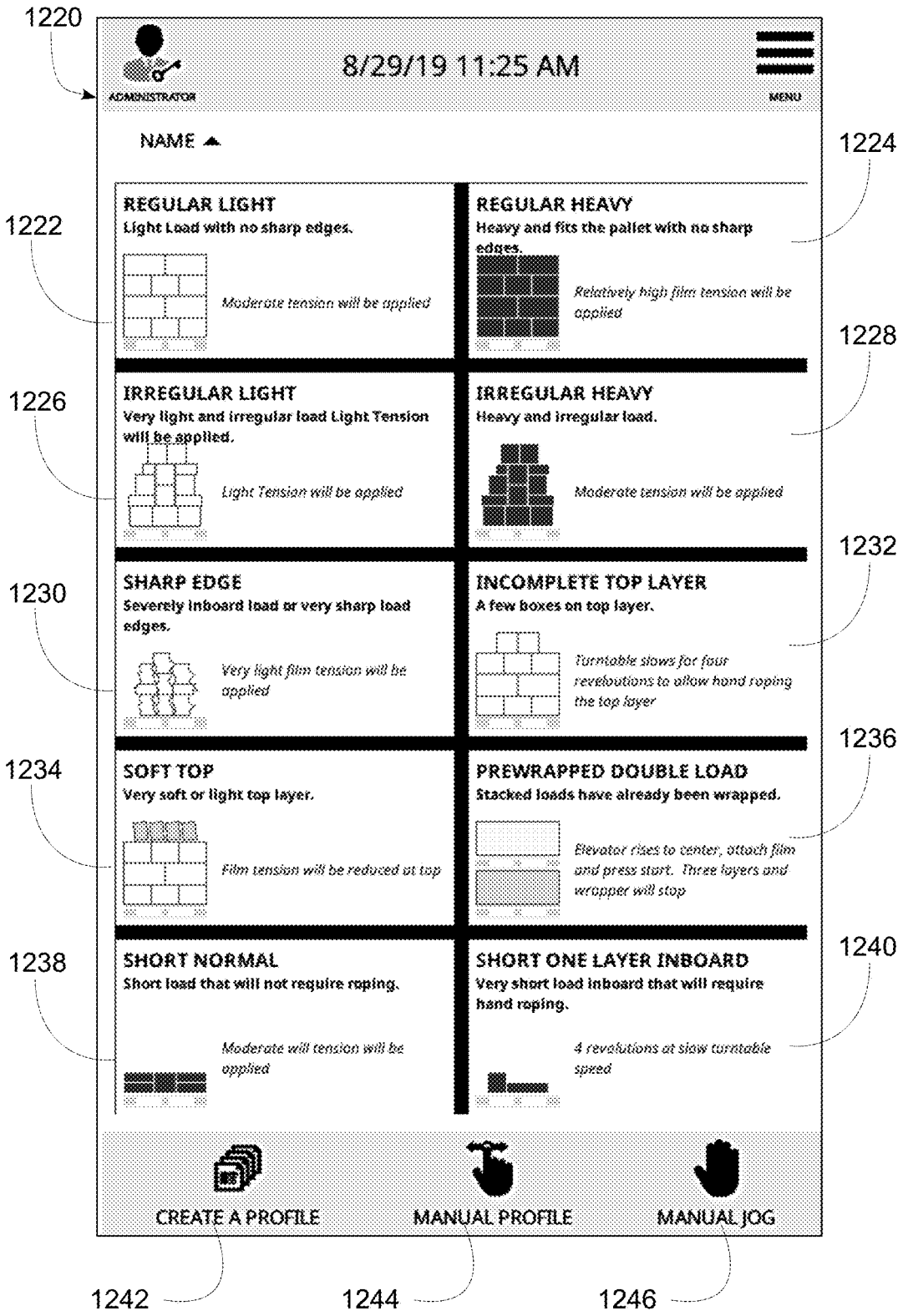
Figure 13:
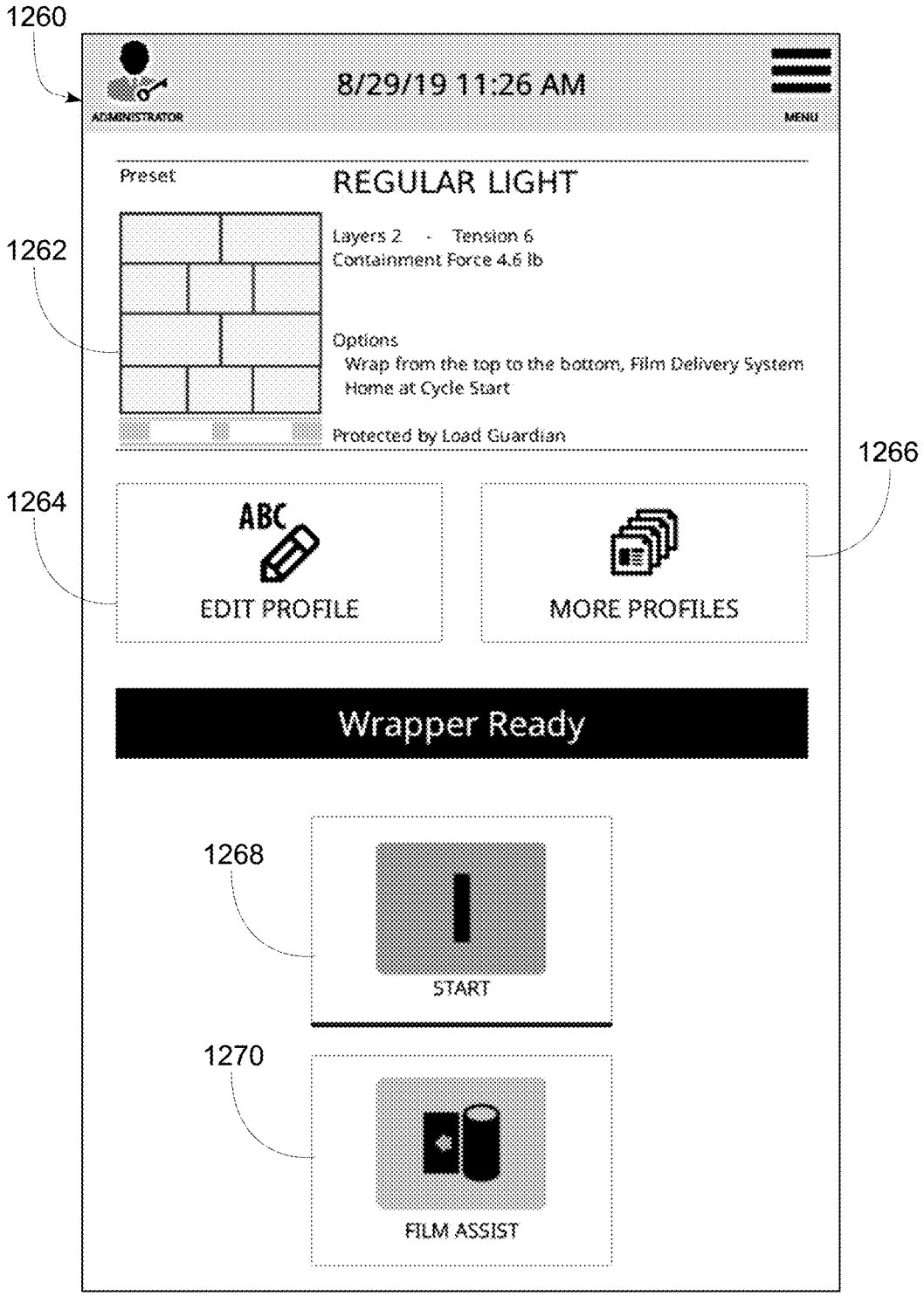

FIGS. 11-13 illustrate an example sequence of displays that may be displayed to an operator on an on-machine display or remote device for use in some embodiments of the invention. FIG. 11, in particular, illustrates a display 1200 that may be an initial screen displayed to an operator, and provides an ability for an operator to initially select a film or packaging material height (width) using slider control 1202, a film or packaging material thickness (gauge) using slider control 1204, and one of a plurality of packaging material "grades" (also referred to as film quality) via a set of buttons 1206, 1208, 1210, 1212. A "continue" button 1214 is also used to advance to a next screen 1220 illustrated in FIG. 12.

As will become more apparent below, in some embodiments it may be desirable to input packaging material characteristics based on a combination of (1) a thickness, gauge or weight per unit length (hereinafter "thickness" may be used to refer to any of these characteristics as all generally vary with the relative thickness of the packaging material) and (2) a grade, which represents a relative "quality" of the packaging material in terms of resistance to flaws, holes, tears, and/or breakage. Various numbers of grades may be used in different embodiments, e.g., more or less than the four grades illustrated in FIG. 11. In the illustrated embodiment, grades are identified as "ultra," "premium," "standard," and "low bid," although it will be appreciated that other nomenclature may be used to represent these different grades. Thus, rather than inputting a specific model or SKU of packaging material, an operator is able to enter a physical characteristic of the packaging material (thickness, gauge or weight per unit length) and a relative grade in order to characterize the packaging material to be used during wrapping.

Now turning to FIG. 12, upon selection of button 1214 of FIG. 11, a display 1220 may be displayed, and may include a set of factory profile buttons 1222-1240 that are associated with a set of most commonly seen loads by users of many stretch wrapping machines, particularly turntable or rotating ring-type machines that are loaded using hand trucks or forklifts. Each factory profile button is associated with a combination of wrap settings associated with a particular type of load. While other combinations of factory profiles may be used in other embodiments, in the illustrated embodiment, ten factory profiles are defined:

1. Regular Light (1222)—a light load with no sharp edges, characterized by moderate wrap force and no special wrap features.

2. Regular Heavy (1224)—a heavier load with no sharp edges, characterized by relatively high wrap force and no special wrap features.

3. Irregular Light (1226)—a very light and/or irregular load with a possibility of sharp edges, characterized by a relatively low wrap force and no special wrap features.

4. Irregular Heavy (1228)—a heavier load with irregularities and a possibility of sharp edges, characterized by moderate wrap force and no special wrap features.

5. Sharp Edge (1230)—a severely inboard load or very sharp load, characterized by a relatively low wrap force and no special wrap features.

6. Incomplete Top Layer (1232)—a load containing an incomplete top layer, characterized by a moderate wrap force and a special wrap feature where the rate of rotation slows for four revolutions to allow an operator to hand rope around the top layer.

7. Soft Top (1234)—a load containing a top layer that is very soft or very light, characterized by a moderate wrap force on the main portion of the load and a special wrap feature where the wrap force is reduced at the top of the load for one or more revolutions.

8. Prewrapped Double Load (1236)—a load containing two previously-wrapped and stacked loads, characterized by a special wrap feature where the carriage is raised to the center of the stack, the operation is paused until an operator can attach the leading end of the packaging material to the load, and three layers of packaging material are wrapped around the center of the stack to secure the two loads together.

9. Short Normal (1238)—a short load that does not require roping, but that is too low to be sensed by a height sensor on the machine, characterized by the application of moderate wrap force around the bottom of the load.

10. Short One Layer Inboard (1240)—a short load that requires roping, characterized by a special wrap feature where four slow relative rotations are performed to enable an operator to hand rope around the load.

Custom profiles, e.g., as described in greater detail above, may also be supported via button 1242, or manual operation may be supported by buttons 1244 and 1246. However, it is believed that the use of factory profiles may enable some operators to more accurately configure a machine for wrapping without having to undergo the effort to create a custom wrap profile.

Factory profiles may, as implied by their names, be set in the factory or otherwise by a manufacturer. In other embodiments, however, factory profiles may be customer or machine specific, and created by a customer or manufacturer based upon a customer's particular needs. A factory profile, in this regard, may be considered to include any profile that incorporates predefined wrap settings, including wrap settings associated with controlling a dispense rate of the packaging material dispenser, and optionally, one or more special wrapping features that address particular wrapping operations. Wrap settings associated with controlling a dispense rate may include, for example, a load containment force requirement, a load stability, an indirect or non-force parameter, a wrap force parameter, a layer parameter, as well as a tension parameter for machines not based upon meeting a desired containment force. Special wrapping features may include slower revolutions, pauses, top/bottom wraps, variances from primary dispense rate controls, roping, and other special features that will be apparent to those of ordinary skill having the benefit of the instant disclosure. It is believed that the provision of a set of factory profiles may encourage operator input such that individual loads are wrapped with greater care for the specific characteristics of those loads, as the burden placed on an operator to select a factory profile is substantially lower than the effort associated with configuring a custom profile, leading to fewer instances of operators simply wrapping based upon whatever profile was selected for the last load.

FIG. 13 next illustrates a display 1260 generated subsequent to an operator selection of a regular light profile using button 1222 of FIG. 12. A display 1262 provides greater details on the associated wrap settings, including a wrap force parameter of 6, a layer parameter of 2, and a load containment force requirement of 4.6 lb. Also, the profile may be edited using button 1264, e.g., to set various options as described above. Button 1266 enables other profiles to be viewed and optionally selected, and button 1268 enables a wrapping operation to be initiated. Button 1270 also provides film assist functionality, e.g., if an operator wishes to characterize a packaging material via testing or evaluation.

Figure 14:
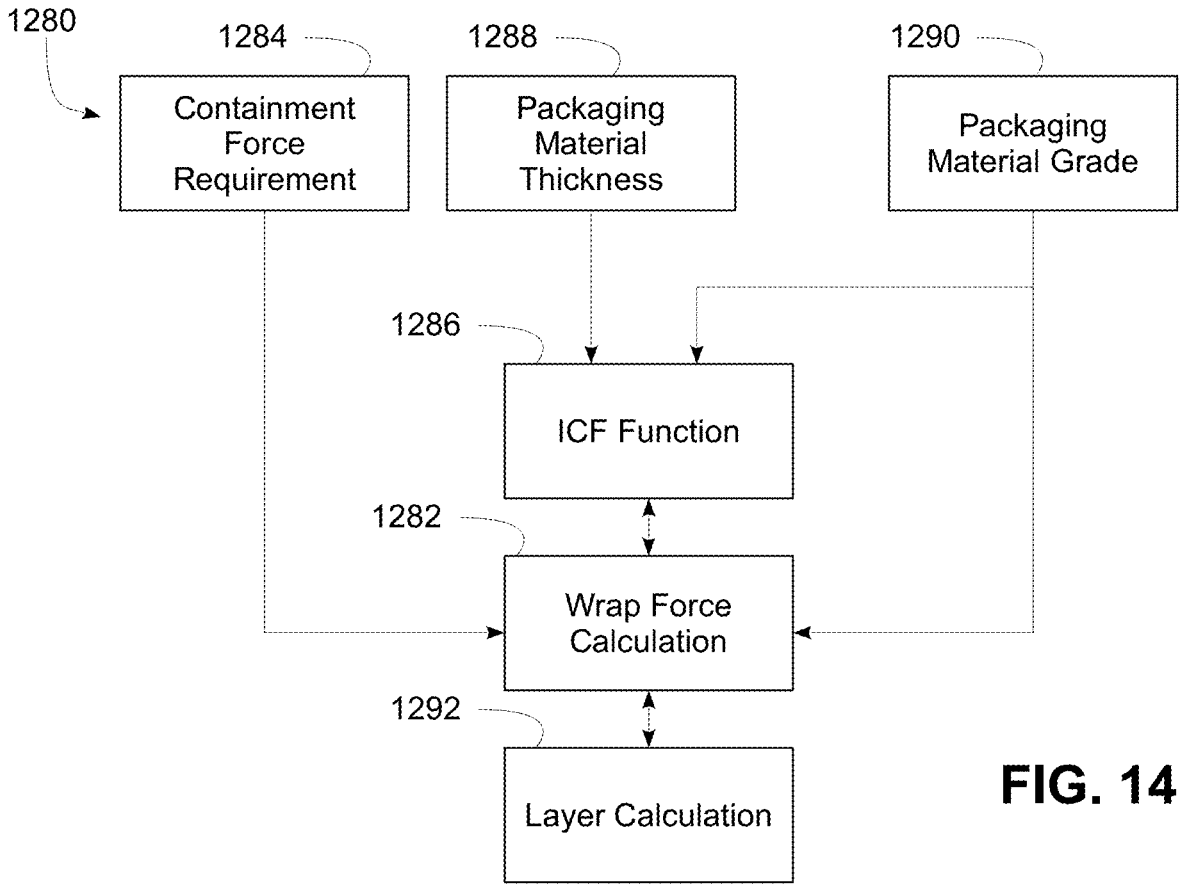
FIG. 14 is a block diagram illustrating wrapping parameter calculations based on packaging material grades.

Now turning to FIG. 14, as noted above, in some embodiments a packaging material may be selected by selecting a combination of a thickness/gauge/weight and a grade. The manner in which such selection may be used in connection with setting wrap parameters is illustrated at 1280, where a wrap force calculation is performed based on a load containment force requirement 1284 and an ICF calculated based upon an ICF function 1286. The ICF function 1286 outputs an ICF to be used based upon a packaging material thickness 1288 (or gauge or weight) and a packaging material grade 1290. In addition, in the illustrated embodiment, the grade is also used as an input to the wrap force calculation 1282. The wrap force calculation 1282 also interacts with a layer calculation 1292 such that a wrap force parameter and a layer parameter may be generated to meet a load containment force requirement based upon the selected characteristics of the packaging material to be used.

In some embodiments, for example, an ICF function may be developed to map both packaging material thickness (or gauge or weight) and grade to a particular ICF. Such an ICF function may be determined, for example, based upon testing or evaluation of a large number of packaging materials from different manufacturers and of different thicknesses and grades. In some embodiments, for example, an ICF function that varies over a range of wrap forces may be scaled based upon the thickness input, given that ICF generally increases with increasing thickness. Further, the same ICF function may be scaled additionally based upon the grade input, such that, for any given combination of thickness and grade, a range of ICF values over a range of wrap forces may be determined. A wrap force calculation may therefore select an appropriate ICF value within the range based upon the determined wrap force value. In addition, as illustrated by the arrow from block 1290 to block 1282, the grade may also be used to select a wrap force, thereby effectively moving along the graph defined by the range of ICF values defined by the function. It will be appreciated, in particular, that as the grade increases, a packaging material is less resistant to tearing, so higher wrap forces may be used when wrapping with that packaging material, thereby altering the wrap force calculation to favor a higher wrap force.

As discussed above, in some embodiments, a default number of layers (e.g., one or two) may be selected and varied only when a wrap force needed to achieve a load containment force requirement would exceed wrap force limit for the packaging material. In the illustrated embodiment therefore, different grades may be used to define the wrap force limit such that the layer calculation 1292 adds layers based upon the relative grade of the packaging material. In other embodiments, however blocks 1282 and 1292 may be combined such that wrap force and layers are calculated cooperatively based upon the aforementioned inputs.

It will also be appreciated that a mapping as described above, which maps wrap force, number of layers and film thickness to load containment force requirements, may also be modified in some embodiments to additionally include packaging material grade, such that a single mapping may be used to determine wrap force and layer parameters based upon the load containment force requirements and packaging material thickness and grade.

Figure 15:
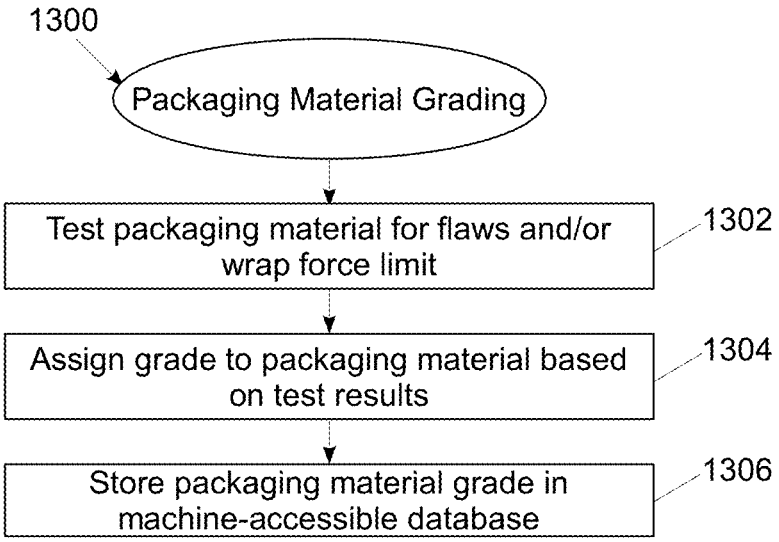
FIG. 15 is a flowchart illustrating an example sequence of operations for grading a packaging material consistent with some embodiments of the invention.

FIG. 15 next illustrates an example sequence of operations 1300 for grading a packaging material. As illustrated in block 1302, grading may be performed, for example, by a testing the packaging material for flaws, wrap force limit, tear resistance, or other performance metrics, e.g., as disclosed in the aforementioned U.S. provisional patent application Ser. No. 62/821,146. A grade may then be assigned in block 1304, e.g., based upon some quantitative assessment or a comparison against other packaging materials. The grade may then be stored in a database in block 1306 for access by a stretch wrapping machine. The grade may be used, for example, to enable an operator to enter a model number or SKU for a particular packaging material and have the thickness and grade pre-selected in display 1200. The grade may also be varied by an operator, e.g., if an excessive number of film breaks are being experienced, a lower grade may be selected at least temporarily (e.g., in the event that the currently-installed film roll is defective).

Other embodiments will be apparent to those skilled in the art from consideration of the specification and practice of the present invention. It is intended that the specification and examples be considered as exemplary only, with a true scope and spirit of the disclosure being indicated by the following claims.

What is claimed is:

1. A method of controlling a load wrapping apparatus of the type configured to wrap a load on a load support with packaging material dispensed from a packaging material dispenser through relative rotation between the packaging material dispenser and the load support, the method comprising:

receiving a first input data that selects a packaging material thickness;

receiving a second input data that selects a packaging material grade;

determining an incremental containment force using the first and second input data;

determining a wrap force parameter for use in wrapping the load using the incremental containment force determined using the first and second input data; and controlling a dispense rate of the packaging material dispenser during the relative rotation based on the determined wrap force parameter.

2. The method of claim 1, wherein the grade is selected from among a plurality of predetermined grades.

3. The method of claim 2, wherein the grade is selected from among an ultra grade, a premium grade, a standard grade and a low bid grade.

4. The method of claim 1, further comprising maintaining a mapping of a plurality of load containment forces to a plurality of corresponding wrap forces and a plurality of corresponding numbers of layers of packaging material and receiving a third input data associated with a load containment force requirement to be used when wrapping the load with packaging material, wherein determining the wrap force parameter includes accessing the mapping based upon the third input data to determine a corresponding wrap force parameter and a corresponding layer parameter for the load containment force requirement, and wherein controlling the dispense rate is further based on the determined corresponding layer parameter.

5. The method of claim 4, wherein the layer parameter specifies a minimum number of layers of packaging material to apply throughout a contiguous region of the load.

6. The method of claim 4, wherein the layer parameter specifies an amount of overlap between successive revolutions, a carriage or elevator speed, a number of up and/or down passes of a carriage or elevator, or a number of relative revolutions.

7. The method of claim 4, wherein the mapping maps the corresponding wrap force and layer parameters for the load containment force requirement further based on the packaging material thickness and the packaging material grade.

8. The method of claim 1, wherein determining the incremental containment force using the first and second input data includes determining the incremental containment force from an incremental containment force function that uses the first and second input data as inputs and that varies across a range of packaging material thicknesses and a range of grades.

9. The method of claim 1, further comprising determining the wrap force parameter based on a factory profile.

10. The method of claim 9, further comprising receiving third input data selecting the factory profile from a set of predefined factory profiles, each profile in the set of predefined factory profiles including one or more wrap settings and optionally one or more special wrapping features.

11. The method of claim 10, wherein the set of predefined factory profiles includes a regular light profile, a regular heavy profile, an irregular light profile, an irregular heavy profile, a sharp edge profile, an incomplete top layer profile, a soft top profile, a prewrapped double load profile, a short normal profile and/or a short one layer inboard profile.

12. A method of controlling a load wrapping apparatus of the type configured to wrap a load on a load support with packaging material dispensed from a packaging material dispenser through relative rotation between the packaging material dispenser and the load support, the method comprising:

generating a display including a plurality of user-selectable factory profile buttons respectively corresponding to a set of predefined factory profiles, each predefined factory profile in the set of predefined factory profiles including one or more wrap settings, and at least one predefined factory profile in the set of predefined factory profiles further including a special wrapping feature;

receiving a first input data selecting a first user-selectable factory profile button among the plurality of user-selectable factory profile buttons to select a first predefined factory profile from the set of predefined factory profiles that corresponds to the first user-selectable factory profile button; and controlling a dispense rate of the packaging material dispenser during the relative rotation based on the first predefined factory profile, determining if the first predefined factory profile includes a first special wrapping feature, and if the first predefined factory profile includes the first special wrapping feature, performing the first special wrapping feature;

wherein the set of predefined factory profiles includes an incomplete top layer profile for loads having incomplete top layers, wherein the incomplete top layer profile specifies a moderate wrap force parameter and a special feature that causes a rate of rotation to slow for a predetermined number of relative revolutions to allow an operator to hand rope around a top layer of the load.

13. The method of claim 12, wherein the set of predefined factory profiles includes a regular light profile for light loads without sharp edges and requiring no special features, wherein the regular light profile specifies a moderate wrap force parameter.

14. The method of claim 12, wherein the set of predefined factory profiles includes a regular heavy profile for heavier loads without sharp edges and requiring no special features, wherein the regular heavy profile specifies a high wrap force parameter.

15. The method of claim 12, wherein the set of predefined factory profiles includes an irregular light profile for light loads and/or irregular loads with sharp edges and requiring no special features, wherein the irregular light profile specifies a low wrap force parameter.

16. The method of claim 12, wherein the set of predefined factory profiles includes an irregular heavy profile for heavier loads with irregularities and/or with sharp edges and requiring no special features, wherein the irregular heavy profile specifies a moderate wrap force parameter.

17. The method of claim 12, wherein the set of predefined factory profiles includes a sharp edge profile for severely inboard loads and/or very sharp loads and requiring no special features, wherein the regular light profile specifies a low wrap force parameter.

18. The method of claim 12, wherein the set of predefined factory profiles includes a soft top profile for loads having top layers that are soft and/or light, wherein the soft top profile specifies a moderate wrap force parameter and a special feature that reduces the wrap force parameter at the top of the load for one or more relative revolutions.

19. The method of claim 12, wherein the set of predefined factory profiles includes a prewrapped double load profile for loads having two previously-wrapped and stacked loads, wherein the prewrapped double load profile specifies a special feature that raises a carriage to a center of a stack of two loads, pauses until a leading end of packaging material is attached, and wraps a predetermined number of layers of packaging material around the center of the stack.

20. The method of claim 12, wherein the set of predefined factory profiles includes a short normal profile for short loads, wherein the short normal profile specifies a moderate wrap force parameter and a special feature that wraps packaging material around a bottom of the load.

21. The method of claim 12, wherein the set of predefined factory profiles includes a short one layer profile for short loads requiring roping, wherein the short one layer profile specifies a special feature that wraps at a slow rate for a predetermined number of relative revolutions to enable an operator to hand rope around the load.

22. The method of claim 12, wherein the set of predefined factory profiles includes a regular light profile, a regular heavy profile, an irregular light profile, an irregular heavy profile, a sharp edge profile, an incomplete top layer profile, a soft top profile, a prewrapped double load profile, a short normal profile and a short one layer inboard profile.

23. An apparatus for wrapping a load with packaging material, the apparatus comprising:

a packaging material dispenser for dispensing packaging material to the load;

a rotational drive configured to generate relative rotation between the packaging material dispenser and the load about a center of rotation; and a controller coupled to the packaging material dispenser and the rotational drive and configured to:

receive a first input data that selects a packaging material thickness;

receive a second input data that selects a packaging material grade;

determine an incremental containment force using the first and second input data;

determine a wrap force parameter for use in wrapping the load using the incremental containment force determined using the first and second input data; and control a dispense rate of the packaging material dispenser during the relative rotation based on the determined wrap force parameter.

24. The apparatus of claim 23, wherein the grade is selected from among a plurality of predetermined grades.

25. The apparatus of claim 24, wherein the grade is selected from among an ultra grade, a premium grade, a standard grade and a low bid grade.

26. The apparatus of claim 23, wherein the controller is further configured to maintain a mapping of a plurality of load containment forces to a plurality of corresponding wrap forces and a plurality of corresponding numbers of layers of packaging material and receiving a third input data associated with a load containment force requirement to be used when wrapping the load with packaging material, wherein the controller is configured to determine the wrap force parameter by accessing the mapping based upon the third input data to determine a corresponding wrap force parameter and a corresponding layer parameter for the load containment force requirement, and wherein the controller is configured to control the dispense rate is further based on the determined corresponding layer parameter.

27. The apparatus of claim 26, wherein the layer parameter specifies a minimum number of layers of packaging material to apply throughout a contiguous region of the load.

28. The apparatus of claim 26, wherein the layer parameter specifies an amount of overlap between successive revolutions, a carriage or elevator speed, a number of up and/or down passes of a carriage or elevator, or a number of relative revolutions.

29. The apparatus of claim 26, wherein the mapping maps the corresponding wrap force and layer parameters for the load containment force requirement further based on the packaging material thickness and the packaging material grade.

30. The apparatus of claim 23, wherein the controller is configured to determine the incremental containment force using the first and second input data by determining the incremental containment force from an incremental containment force function that uses the first and second input data as inputs and that varies across a range of packaging material thicknesses and a range of grades.

31. The apparatus of claim 23, wherein the controller is further configured to determine the wrap force parameter based on a factory profile.

32. The apparatus of claim 31, wherein the controller is further configured to receive third input data selecting the factory profile from a set of predefined factory profiles, each profile in the set of predefined factory profiles including one or more wrap settings and optionally one or more special wrapping features.

33. The apparatus of claim 32, wherein the set of predefined factory profiles includes a regular light profile, a regular heavy profile, an irregular light profile, an irregular heavy profile, a sharp edge profile, an incomplete top layer profile, a soft top profile, a prewrapped double load profile, a short normal profile and/or a short one layer inboard profile.

34. A method of controlling a load wrapping apparatus of the type configured to wrap a load on a load support with packaging material dispensed from a packaging material dispenser through relative rotation between the packaging material dispenser and the load support, the method comprising:

generating a display including a plurality of user-selectable factory profile buttons respectively corresponding to a set of predefined factory profiles, each predefined factory profile in the set of predefined factory profiles including one or more wrap settings, and at least one predefined factory profile in the set of predefined factory profiles further including a special wrapping feature;

receiving a first input data selecting a first user-selectable factory profile button among the plurality of user-selectable factory profile buttons to select a first predefined factory profile from the set of predefined factory profiles that corresponds to the first user-selectable factory profile button; and controlling a dispense rate of the packaging material dispenser during the relative rotation based on the first predefined factory profile, determining if the first predefined factory profile includes a first special wrapping feature, and if the first predefined factory profile includes the first special wrapping feature, performing the first special wrapping feature;

wherein the set of predefined factory profiles includes a prewrapped double load profile for loads having two previously-wrapped and stacked loads, wherein the prewrapped double load profile specifies a special feature that raises a carriage to a center of a stack of two loads, pauses until a leading end of packaging material is attached, and wraps a predetermined number of layers of packaging material around the center of the stack.

* * * * *